US006443074B1

(12) United States Patent
Adams et al.

(10) Patent No.: US 6,443,074 B1
(45) Date of Patent: Sep. 3, 2002

(54) FOLDING TABLE

(75) Inventors: William E. Adams, Harmony; David M. Fountain, Portersville, both of PA (US); Theodore Bloom, Warren, OH (US)

(73) Assignee: Adams Manufacturing Corp., Portersville, PA (US)

( * ) Notice: Subject to any disclaimer, the term of this patent is extended or adjusted under 35 U.S.C. 154(b) by 0 days.

(21) Appl. No.: 09/478,607

(22) Filed: Jan. 6, 2000

(51) Int. Cl.[7] ..... A47B 3/02
(52) U.S. Cl. ..... 108/118; 108/179; 108/157.16
(58) Field of Search ..... 108/118, 119, 108/120, 174, 173, 179, 157.16

(56) References Cited

U.S. PATENT DOCUMENTS

| | | | | | |
|---|---|---|---|---|---|
| 3,692,358 | A | * | 9/1972 | Sung | 108/118 |
| 3,704,674 | A | | 12/1972 | Johnson | |
| 4,168,669 | A | * | 9/1979 | Arnoff | 108/119 |
| 4,190,001 | A | | 2/1980 | Cecala | |
| 4,229,038 | A | | 10/1980 | Drost | |
| 4,544,203 | A | * | 10/1985 | Younger et al. | 108/119 |
| 4,669,622 | A | | 6/1987 | Bennett | |
| 4,793,265 | A | | 12/1988 | Morris | |
| 5,127,537 | A | | 7/1992 | Graham | |
| 5,271,536 | A | | 12/1993 | Wilson | |
| 5,483,901 | A | * | 1/1996 | Tisbo et al. | 108/119 |
| 5,584,254 | A | | 12/1996 | Williams | |
| D394,361 | S | | 5/1998 | Adams et al. | |
| 5,826,957 | A | | 10/1998 | DeBartolo, Jr. et al. | |
| D407,235 | S | | 3/1999 | Cunningham et al. | |

FOREIGN PATENT DOCUMENTS

| | | | | |
|---|---|---|---|---|
| GB | 2186790 | * | 8/1987 | 108/118 |

OTHER PUBLICATIONS

IKEA Catalog, ©1990, p. 75.

* cited by examiner

*Primary Examiner*—Peter M. Cuomo
*Assistant Examiner*—Jerry A. Anderson
(74) *Attorney, Agent, or Firm*—Kirkpatrick & Lockhart LLP

(57) ABSTRACT

A table having a base including legs, first and second table top portions that form a table top surface when the table is in the assembled position, and pivotable connectors that connect the first and second table top portions to the base. The pivotable connectors allow for the first and second table top portions and the legs to collapse into a vertical position such that the table can be easily stored and carried. The table top is supported when it is in assembled position by a variety of devices such that the table top will not flex or deform. Pivotable connections are also provided between the legs allowing the legs to form a crisscross pattern when the table is in the assembled position.

27 Claims, 21 Drawing Sheets

FOLDING TABLE

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to folding tables. More specifically, the present invention concerns a portable, foldable table that is made of lightweight material, is sturdy and can be folded into a compact unit for easy carrying and storage.

2. Description of the Background of the Invention

Some conventional folding tables comprise twin table top portions each having a surface and limb members which are pivotably connected to a supporting frame. The frame has two pairs of legs that are pivotably connected such that the two pair of legs can be transformed from an opened position, where the legs form a crisscross pattern and the twin table top portions form the flat surface, to a closed position, where the legs are collapsed into a vertical position and the twin table top portions are also collapsed such that they are separated and substantially parallel to one another. Certain forms of this type of folding table have the disadvantage of being unstable and prone to being overturned because of frail connections between the limbs and the legs. For instance, when the table is bumped by a person walking past the table or getting up from being seated at the table, the limbs can be easily disconnected from the legs.

Another disadvantage of this type of folding table is that the table top section is usually a relatively small table top surface that can only support light items placed on the table. Generally, no support is provided across the span of the table top surface to prevent it from flexing or turning over if a heavy item is placed at the edge of the table top surface.

Accordingly, the need exists for a foldable, portable table having a table top surface that is strong enough to support a variety of sized items without resulting in the table top flexing or the table turning over.

There is also a need for a foldable, portable table having sturdy pivotable connections between the table top portions and the legs which provide for the table not being inadvertently collapsed when the table is bumped or when a heavy item is placed thereon.

SUMMARY OF THE PRESENT INVENTION

The present invention provides a foldable, portable table having a sturdy construction and resistant to being overturned or collapsing when a variety of items are placed on the table top surface or when the table is bumped, while at the same time being able to be easily disassembled, carried and stored.

The present invention further provides a table having a base including legs, first and second table top portions that form a table top surface, and pivotable connectors that pivotably connect the first and second table top portions to the legs. The pivotable connectors may take the form of lug members and mating apertures. However, the pivotable connectors can take many other forms, as will be appreciated by one skilled in the art.

The present invention further provides a foldable and portable table having first and second table top portions, legs, and a pivotable connection between the table top portions and the legs, such that when the table is in the assembled position, the table top portions are horizontally supported by the legs and when the table is in the collapsed position, the table top portions and the legs collapse into a vertical position such that the table is easily carried and stored. The pivotable connections between the table top portions and the legs may take the form of a lug with at least one protuberance along the periphery thereof and an aperture with at least one slot along its periphery in each of the legs such that the lug is received by the aperture and the protuberance is received by the slot in a locking and tightening fashion.

The present invention further provides various supporting devices that support the table top of the folding table and making it resistant to flexing and deformation. For example, the supporting devices may take the form of a bar spanning across the underside of the table top and positioned proximate to the table top underside such that if the table top flexes in a downward direction, the table top may engage the bar and be supported thereby. Additionally, the supporting device of the present invention may also include a plurality of fins that positively engage the underside of the table top portion, when the table is in the assembled position.

The present invention is further provided with projections along the underside of the table top portion that engage mature receptacles in the arm members and act to support and strengthen the table top portions when the table is in the assembled position.

The folding table of the present invention is also provided with a pivotable connection between the two pairs of legs that allows the pairs of legs to be collapsed upon one another for easy carrying and storage when in the collapsed position and also allows for the pairs of legs to form a crisscross pattern when in the assembled position. For example, the pivotable connection may be a boss with a bead along the periphery thereof and a recess that pivotably receives the boss.

These and other advantages and benefits of the present invention will become apparent from the following description of the present invention.

BRIEF DESCRIPTION OF THE DRAWINGS

For the present invention to be readily understood and practiced, several embodiments of the present invention will be described in conjunction with the following figures wherein.

DETAILED DESCRIPTION OF THE INVENTION

Figure 1:
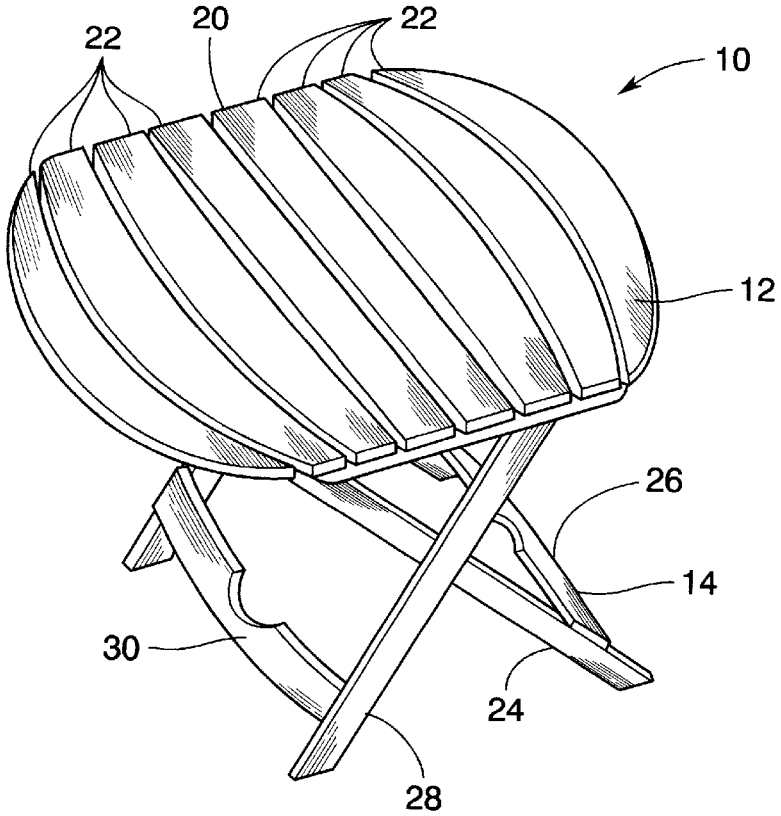
FIG. 1 is a perspective view of a folding table of the present invention in the fully assembled position.

The present invention will be described below in terms of a foldable table. It should be noted that describing the present invention in terms of a foldable table is for illustrative purposes only and the advantages of the present invention may be realized using other structures and technologies. The same reference numerals are used for similar structure throughout this Detailed Description of the Invention.

Figure 2:
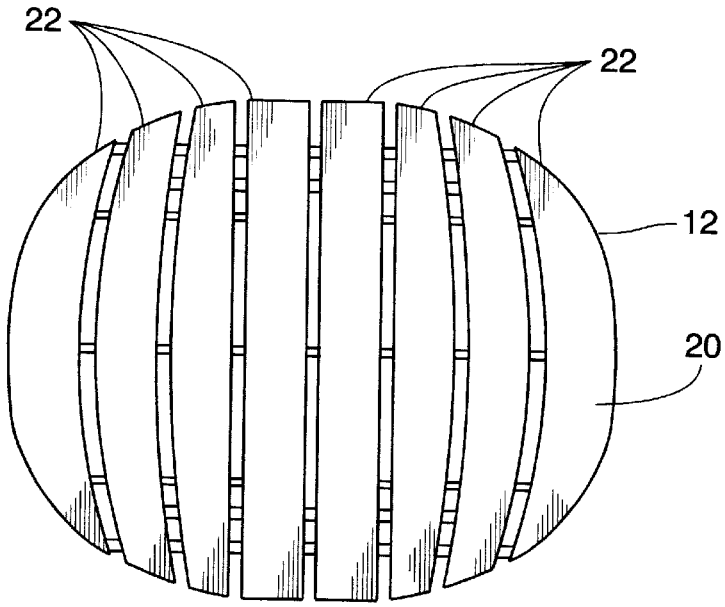
FIG. 2 is a top plan view of the folding table shown in FIG. 1.
Figure 3:
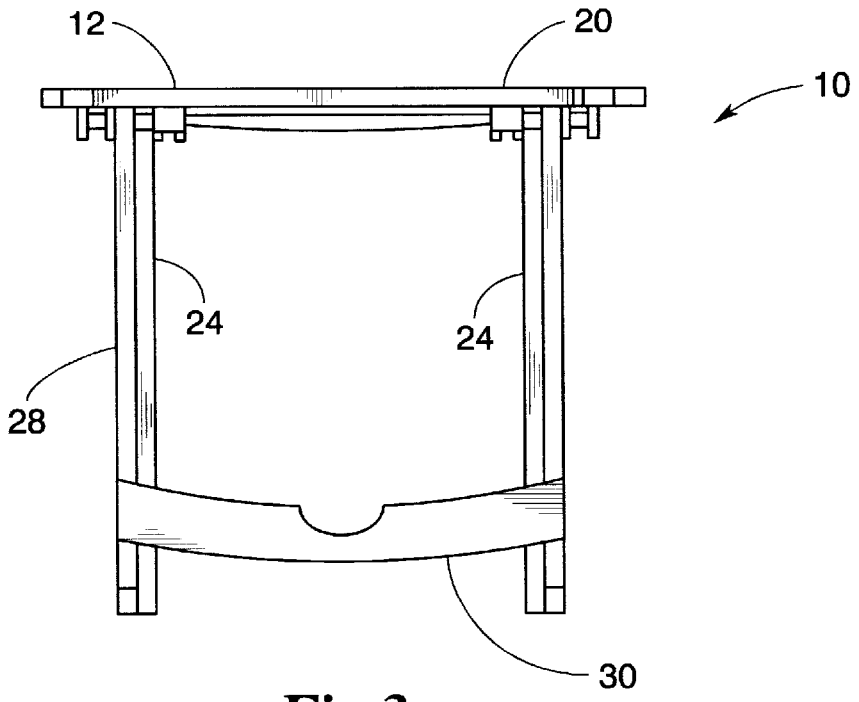
FIG. 3 is a front plan view of the folding table shown in FIG. 1.
Figure 4:
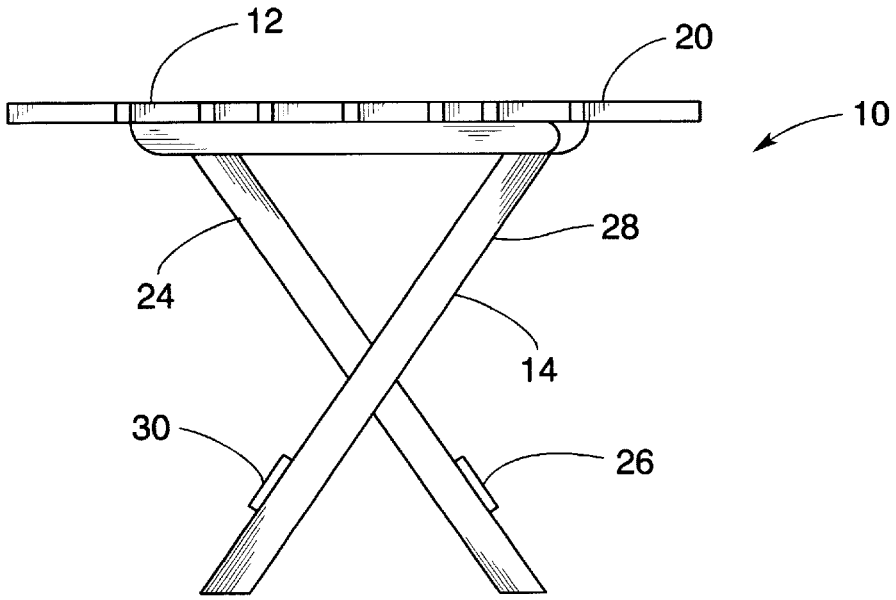
FIG. 4 is a side plan view of the folding table shown in FIG. 1.

Referring to FIGS. 1 through 4, FIG. 1 is a perspective view of the folding table 10 of the present invention in the fully assembled position; FIG. 2 is a top plan view of the folding table 10; FIG. 3 is a front plan view of the folding table 10 also in the fully assembled position; and FIG. 4 is a side plan view of the folding table 10 in the fully assembled position. The folding table 10 of the present invention substantially comprises a table top 12 and a base member 14. The table top 12 substantially comprises a first table top portion 16 and a second table top portion 18 that together form a substantially continuous table top surface 20 having a plurality of slat members 22, all of which are shown in greater detail in FIGS. 5 through 8. The base member 14 substantially comprises a pair of inner legs 24 connected by a first brace member 26 and a pair of outer legs 28 connected by a second brace member 30, all of which are shown in greater detail in FIGS. 9 and 10. The folding table 10 can be made of plastic material such as resin, wood or metal. However, it will be apparent to one of ordinary skill in the art that the folding table 10 of the present invention can be made of several other materials. Furthermore, although the table top 12 is substantially oblong shaped, it may be many sizes and shapes which will be apparent to one of ordinary skill in the art.

Figure 5:
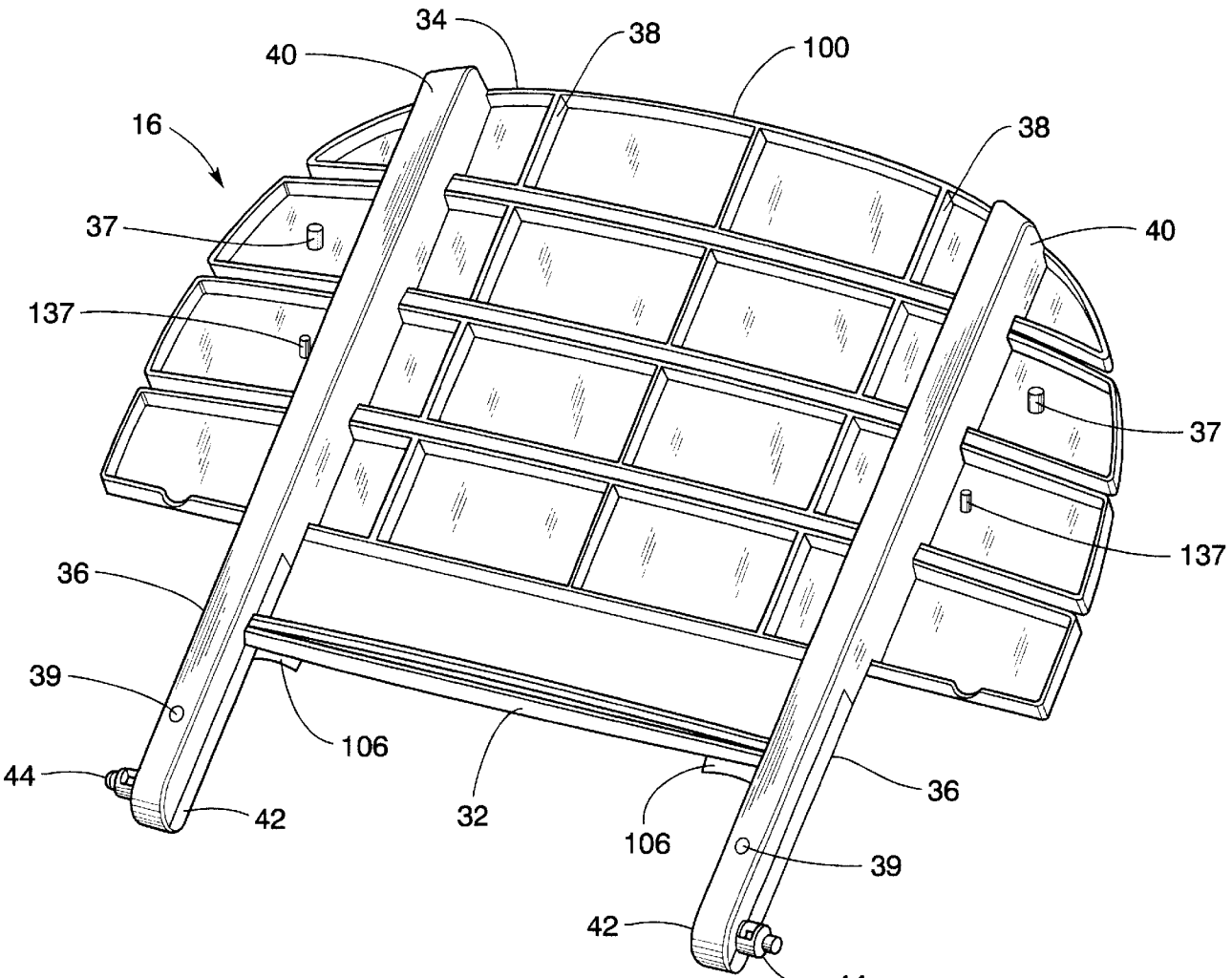
FIG. 5 is a bottom perspective view of a first table top portion of the folding table of the present invention shown in FIG. 1, which includes a handle portion.
Figure 7:
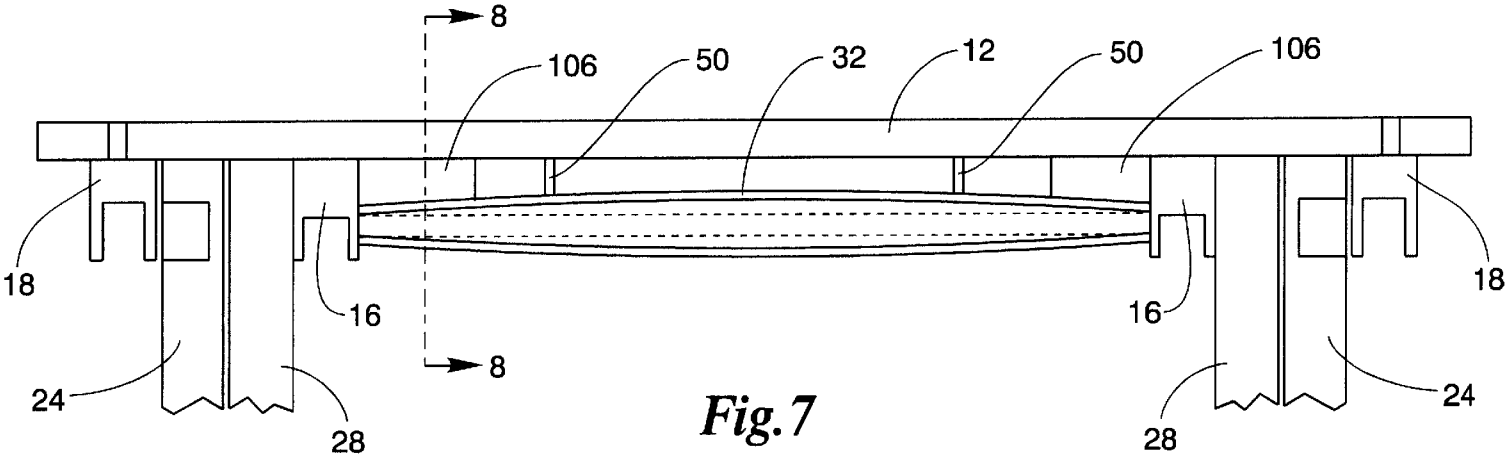
FIG. 7 is a front elevational view of the folding table of the present invention shown in FIG. 1 with a cut-away portion of the table illustrating the handle portion.
Figure 8:
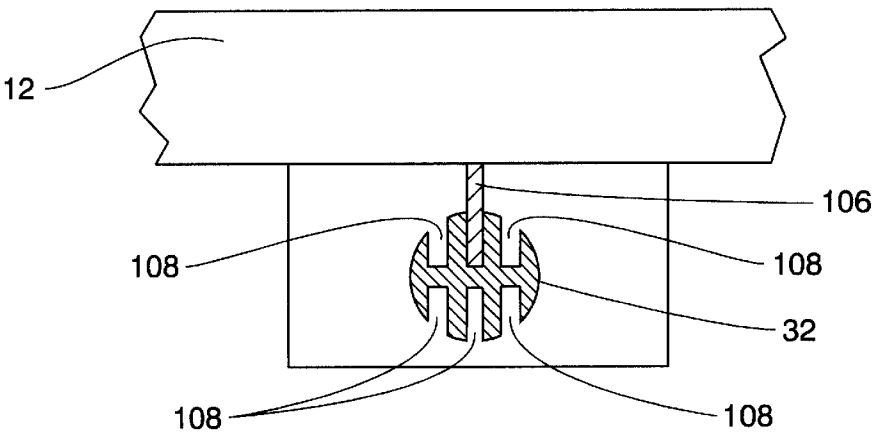
FIG. 8 is a sectional view of the folding table shown in FIG. 7 taken along line 8—8.

FIG. 5 is a bottom perspective view of the first table top portion 16 of the folding table 10 of the present invention including a handle portion 32 and fins 106, which are shown in greater detail in FIGS. 7 and 8. The first table top portion 16 includes a first table top portion half section 34, two arm members 36, and the handle portion 32. The first table top portion half section 34 substantially forms a first section of the table top 12 and includes ribs 38 that extend along the underside thereof, wherein the ribs 38 strengthen the table top 12. Each of the two arm members 36 have a first end 40 and a second end 42, wherein the first ends 40 are connected to the first table top portion 16 such that the arm members 36 extend from the first table top portion 16. The two arm members 36 are spaced apart from one another and are substantially parallel to one another. Each of the arm members 36 also include one receptacle 39, which is described in greater detail in connection with FIGS. 14 through 18. A first pair of projections 37 and a second pair of projections 137 extend from the underside of the first table top portion 16. The first pair of projections 37 and the second pair of projections 137 are described in greater detail in connection with FIGS. 14 through 18 below. The handle portion 32 is a formed rod member that is fixedly connected to the arm members 36 such that the handle portion 32 is substantially perpendicular to the two arm members 36. The handle portion 32 has fins 106 connected thereto. The handle portion 32 is illustrated in greater detail in FIGS. 7 and 8. The arm members 36 also have pivotable connectors 44, shown in greater detail in FIG. 11, positioned on the exterior surface of the arm members 36 such that the pivotable connectors 44 extend away from one another.

Figure 6:
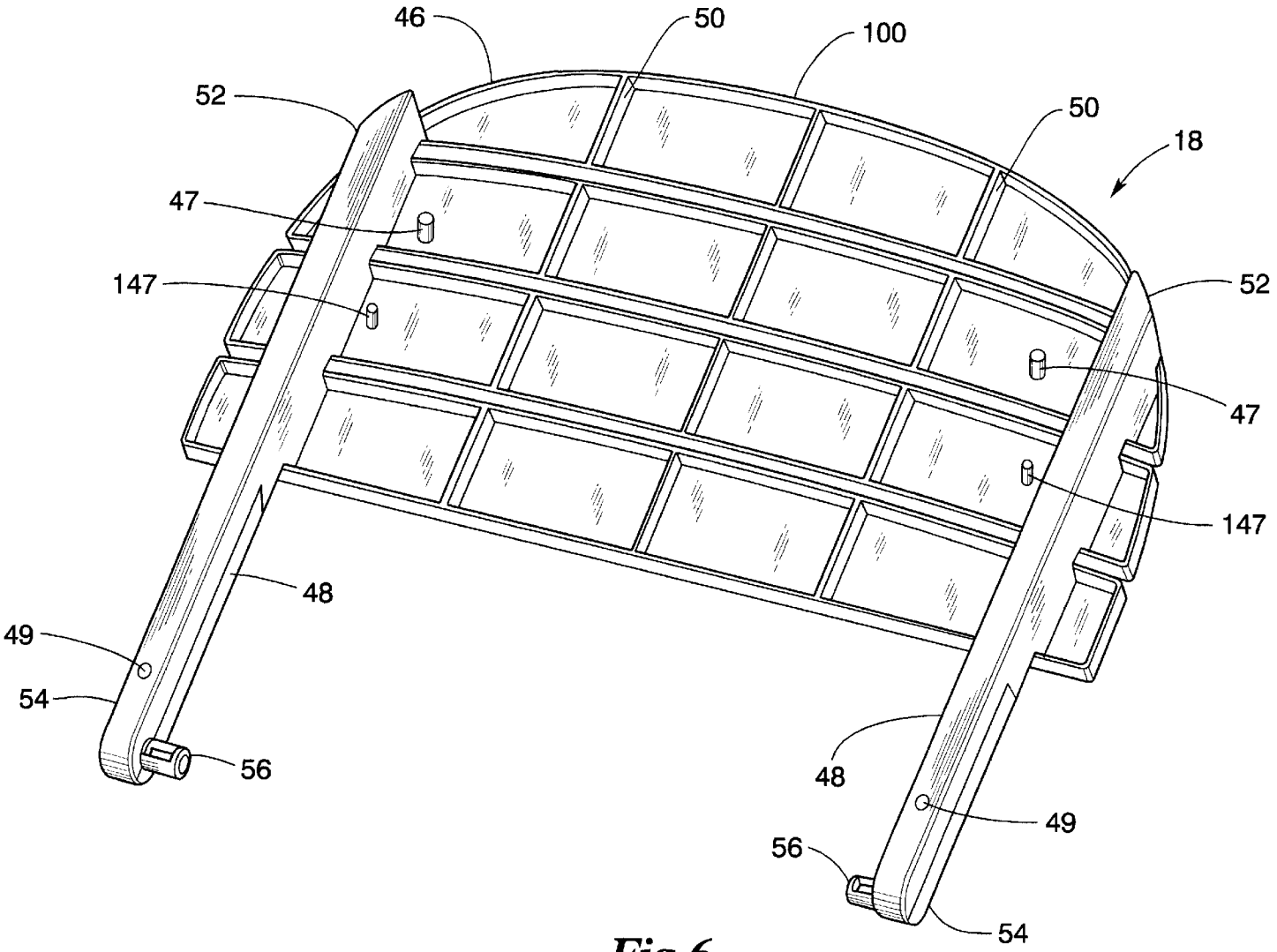
FIG. 6 is a bottom perspective view of a second table top portion of the folding table of the present invention shown in FIG. 1.
Figure 18B:
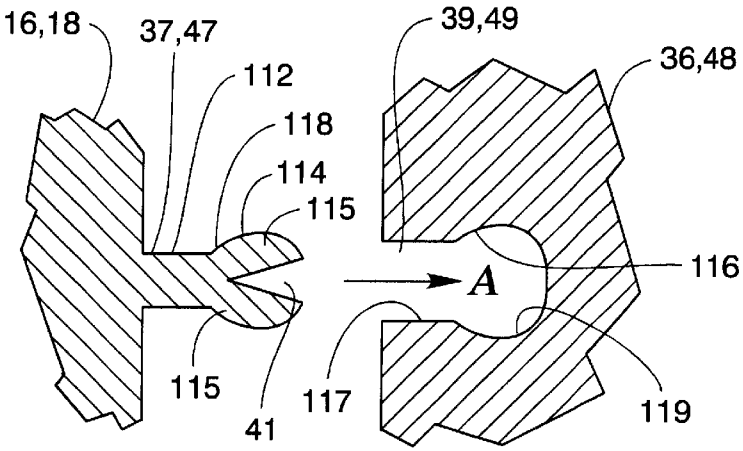
FIG. 18*b* is yet another embodiment of a projection and receptacle connector of the folding table of the present invention.
Figure 19:
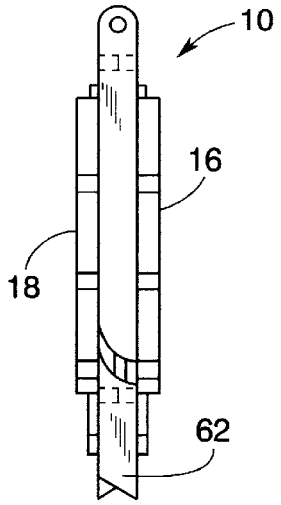
FIG. 19 is a partial side view of the folding table of the present invention shown in FIG. 1 in the fully collapsed position.
Figure 20:
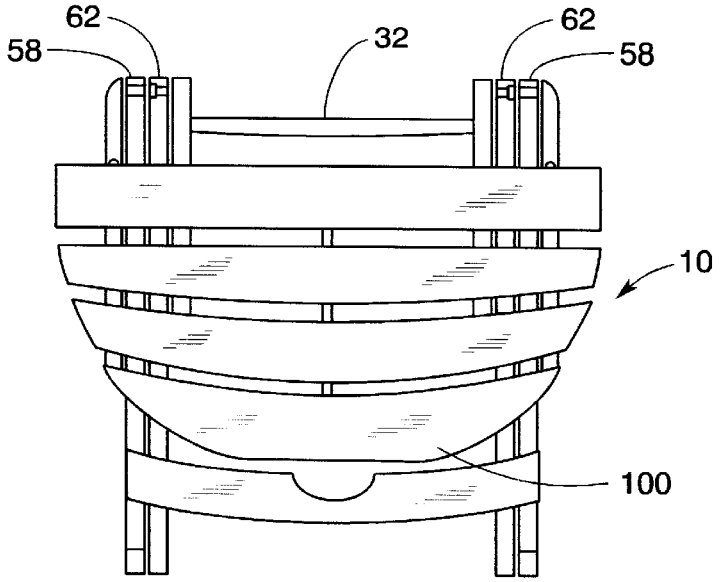
FIG. 20 is a front view of the folding table of the present invention shown in FIG. 1 in the fully collapsed position.

FIG. 6 is a bottom perspective view of the second table top portion 18 of the folding table 10 of the present invention shown in FIG. 1. The second table top portion 18 includes a second table top portion half section 46 and two arm members 48. The second table top portion half section 18 substantially forms a second section of the table top 12 and includes ribs 50 that extend along the underside of the second table top portion half section 46, wherein the ribs 50 strengthen the table top 12. The ribs 50 are sized and proportioned in order that the ribs will engage the handle portion 32 when the folding table 10 is in the fully assembled position, as described in greater detail in connection with FIG. 7. Each of the two arm members 48 have a first end 52 and a second end 54, wherein the first ends 52 are connected to the second table top portion 18 such that the arm members 48 extend from the second table top portion 18. Each of the arm members 48 also includes one receptacle 49, as described in greater detail in connection with FIGS. 14 through 18 below. A first pair of projections 47 and a second pair of projections 147 extend from the underside of the second table top portion 18. The first pair of projections 47 and the second pair of projections 147 are described below in greater detail in connection with FIGS. 14 through 18. The two arm members 48 are spaced apart from one another and are substantially parallel to one another. It should be noted that the arm members 48 are spaced a distance different than the distance that the arm members 36 are spaced from one another such that the pairs of arm members 36 and 48 can form a scissors pattern and can lie in the same horizontal plane when the folding table 10 is in the fully assembled position (FIGS. 3 and 4) and can lie in the same vertical plane when the folding table 10 is in the fully collapsed position (FIGS. 19 and 20). The arm members 48 also have pivotable connectors 56, which are the same as pivotable connectors 44, which will be described in greater detail in connection with FIG. 11. The pivotable connectors 56 are positioned on the interior of the arm members 48 such that the pivotable connectors 56 extend toward one another.

FIG. 7 is a front elevational view of the folding table 10 with part of the table 10 eliminated such that the handle portion 32 and the fin 106 can be clearly illustrated. FIG. 8 is a sectional view of the folding table 10 shown in FIG. 7 taken along line 8—8. As noted above, the handle portion 32 extends between the arm members 36 of the first table top portion 16. The handle portion 32 may be a rod member having a waffle shaped cross-section (FIG. 8); however, it will be apparent to one of ordinary skill in the art that many other configurations may be employed. The waffle configuration has a plurality of longitudinal inlets 108 in the surface of the handle portion 32. Fins or pins 106 may extend radially from and be connected to the handle portion 32. The fins 106 may engage the underside of the table top 12 when the table 10 is in the fully assembled position such that they support the table top 12 and prevent the table top from flexing when several items are placed on the table top 12 by the user. Alternatively, although not illustrated, the fins 106 may be connected to the underside of the table top 12 such that when the table 10 is in the fully assembled position, the fins 106 may engage and rest upon the handle portion 32. Yet another alternative that is not illustrated but may be employed is the handle portion 32 being offset such that when the table 10 is in the fully assembled position, the underside of the table top 12 will directly rest on the handle portion 32. It should be understood that the fins 106 may take many other forms.

Figure 9:
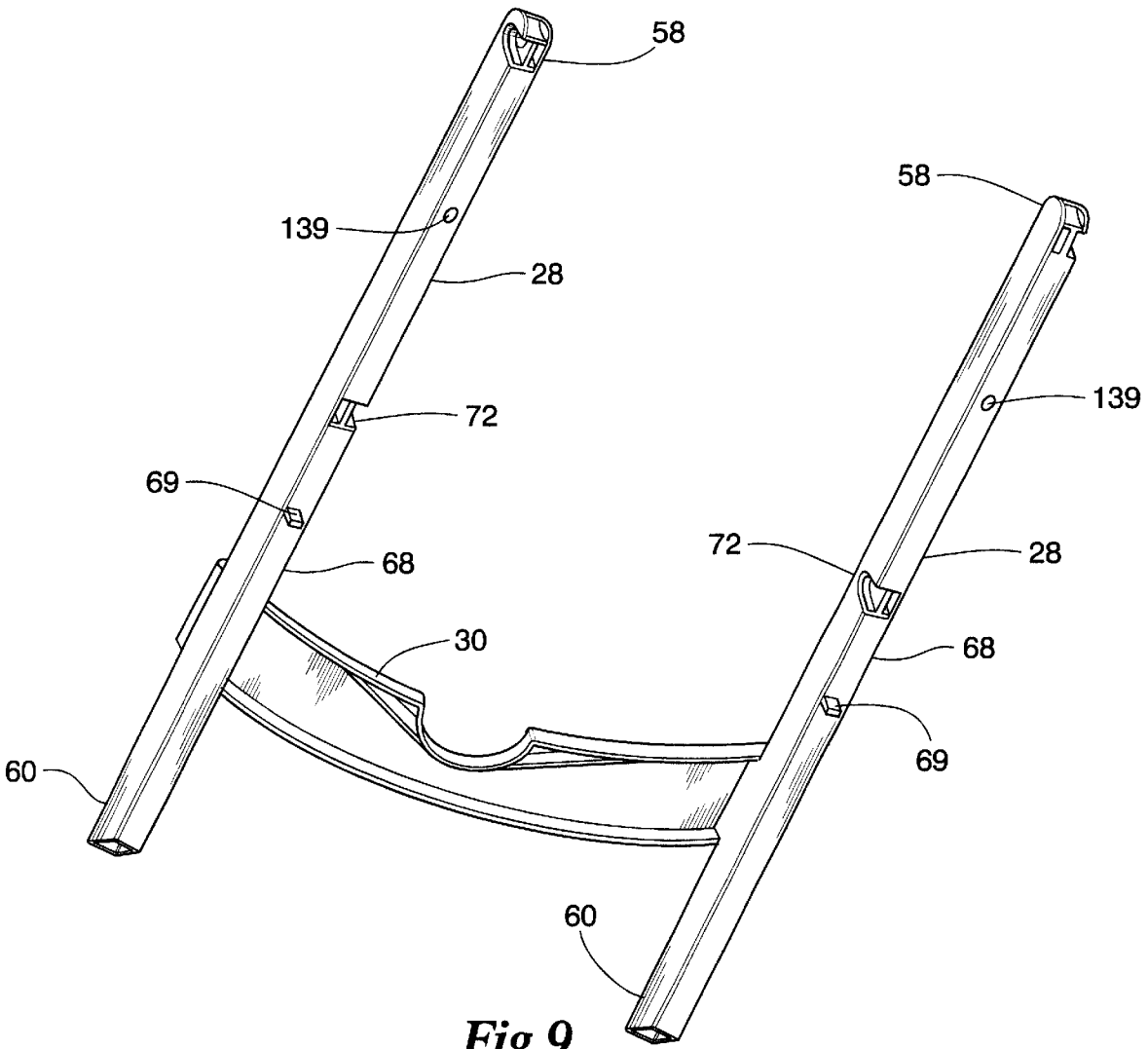
FIG. 9 is a perspective view of a pair of outer legs of the folding table of the present invention shown in FIG. 1.

FIG. 9 is a perspective view of a pair of the outer legs 28 of the folding table 10 of the present invention shown in FIG. 1. The outer pair of legs 28 of the folding table 10 substantially comprises legs 28 each having a first end 58, a second end 60, an intermediate portion 68, and a second brace member 30 connecting the two legs 28. Each of the legs 28 define a recess 72 at the intermediate portion 68 thereof which opens toward the inner portion of the legs 28 such that the recesses 72 face each other. Each of the legs 28 also define a receptacle 139 at the first end portion 58 and a ledge member 69 or buttress at the intermediate portion 68.

Figure 10:
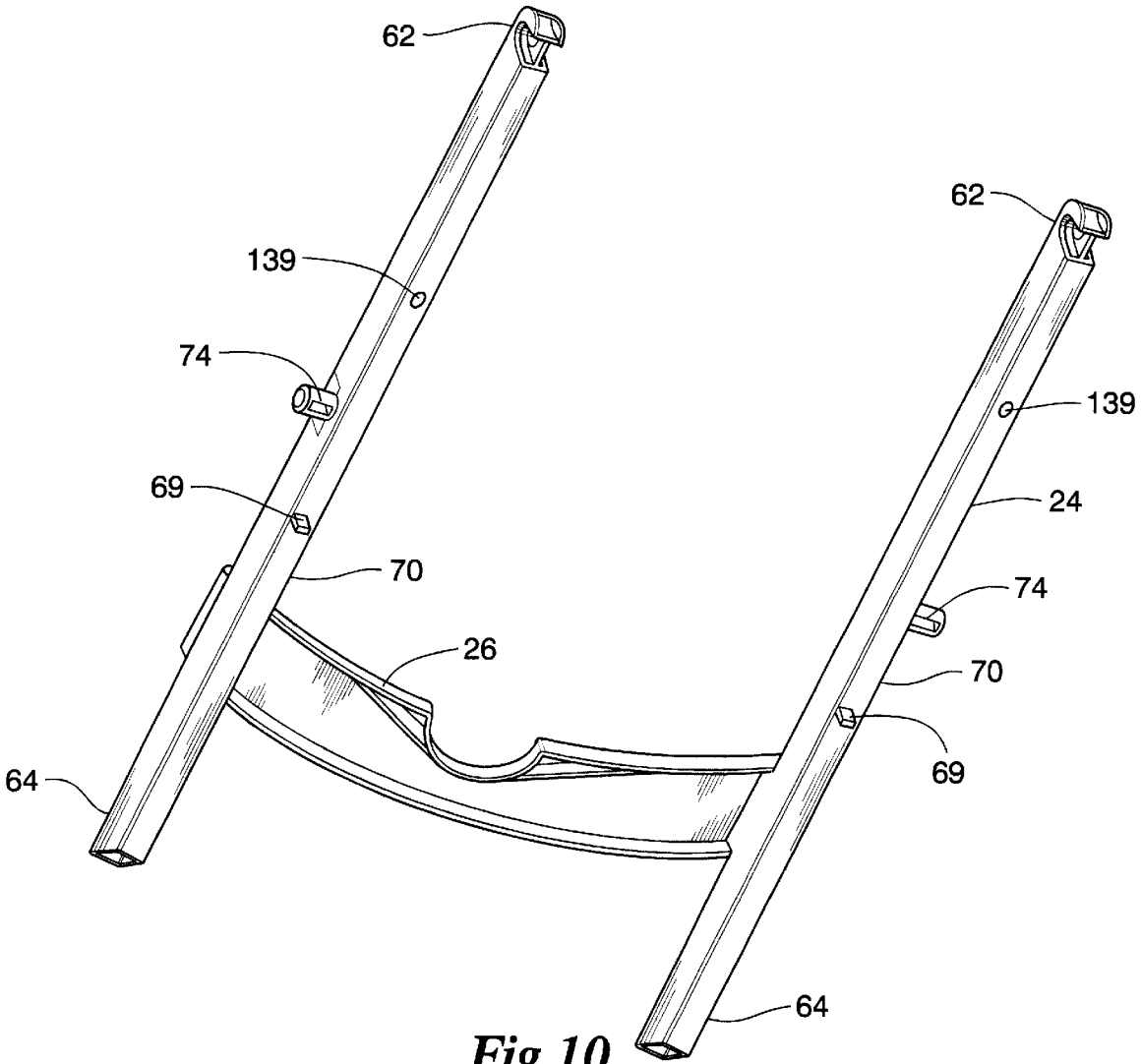
FIG. 10 is a perspective view of a pair of inner legs of the folding table of the present invention shown in FIG. 1.

FIG. 10 is a perspective view of the pair of inner legs 24 of the folding table 10 of the present invention shown in FIG. 1. The pair of inner legs 24 of the folding table 10 substantially comprise legs 24 having a first end 62, a second end 64, an intermediate portion 70, and a first brace member 26 connecting the two legs 24. Each of the legs 24 define a boss 74 at the intermediate portion 70 thereof, wherein the bosses 74 are on the outer portion of the legs 24 and extend away from one another. Each of the legs 24 also define a receptacle 139 at the first end portion 62 and a ledge member 69 at the intermediate portion 70. The second ends 42 and 54 of the arm members 36 and 48 (FIGS. 5 and 6) are pivotablely connected to the first ends 58 and 62 of the legs 28 and 24 by the pivotable connectors 44 and 56, respectively. This pivotable connection is described in greater detail in connection with FIGS. 11, 12*a*, 12*b*, 12*c* and 12*d*. The inner pair of legs 24 are pivotablely connected to the outer pair of legs 28 at their intermediate portions 70 and 68, respectively, by the bosses 74 which are pivotablely received within the recesses 72. This pivotable connection is described in greater detail in connection with FIG. 13. Although the first and second brace members 26 and 30 are curved, the first and second brace members 26 and 30 may take many shapes and sizes. For example, the brace members 26 and 30 can be linear members that connect to the legs 24 and 28 and form a right angle therewith.

Figure 11:
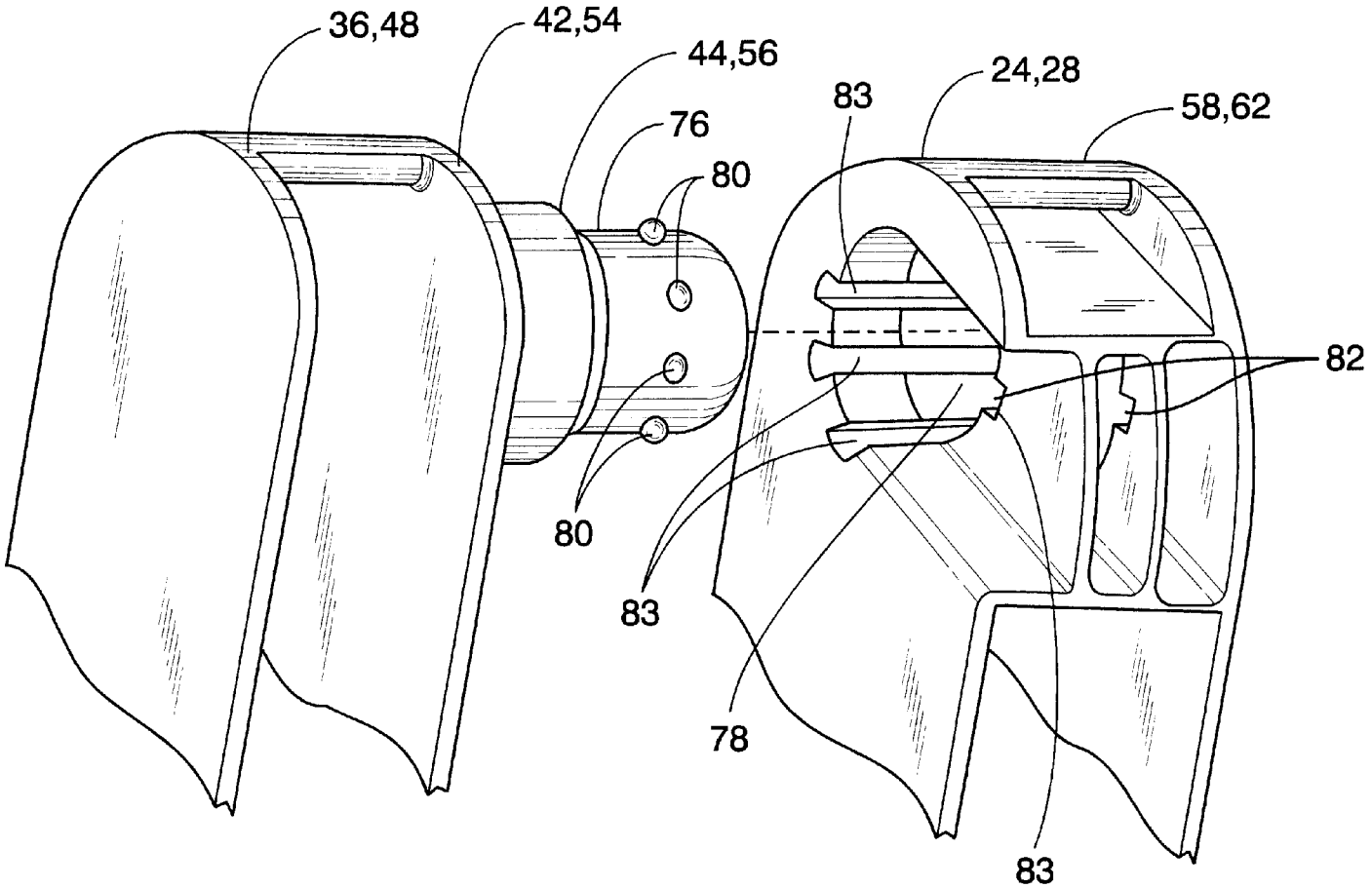
FIG. 11 is an exploded view of a pivotable connection between the arm members of the table top portions and the legs of the base member of the folding table of the present invention.

FIG. 11 is an exploded view of pivotable connectors 44 and 56 which connect the arm members 36 and 48 and the inner and outer pairs of legs 24 and 28 of the base member 14 of the folding table 10 of the present invention. The pivotable connectors 44 and 56 each comprise a lug 76 connected to the arm members second ends 42 and 54, and an aperture 78 defined by the first ends 58 and 62 of the legs 24 and 28 thereof. The lugs 76 each have a plurality of protuberances 80 along the periphery thereof. The aperture 78 has two slots 82 in alignment with one another to form one of a plurality of channels 83 positioned around the periphery of the operative 78. The aperture 78 is sized and proportioned such that the lug 78 can be received within the aperture 78 when the protuberances 80 are aligned with the channels 83, but at no other time. Accordingly, when the protuberances 80 are aligned with the channels 83, the lug 76 is able to enter the aperture 78. The protuberances 80 must remain in alignment with the channels 83 until the protuberances 80 completely pass through the channels 83, at which time the arms 36 and 48 can rotate relative to the legs 24 and 28 and be locked into the fully assembled position (FIGS. 1 through 4). Although not illustrated, the present invention may also comprise lug members 76 having two diametrically opposed protuberances 80 and the base member 14 having two diametrically opposed channels 83 which receive the diametrically opposed protuberances 80. However, the more channels 83 in each of the pairs of legs 24 and 28, the less plastic material is needed to make the pairs of legs 24 and 28, thus, the less shrinkage will result during the molding process and the better fit between the legs 24 and 28 and the arm members 36 and 48.

Figure 12A:
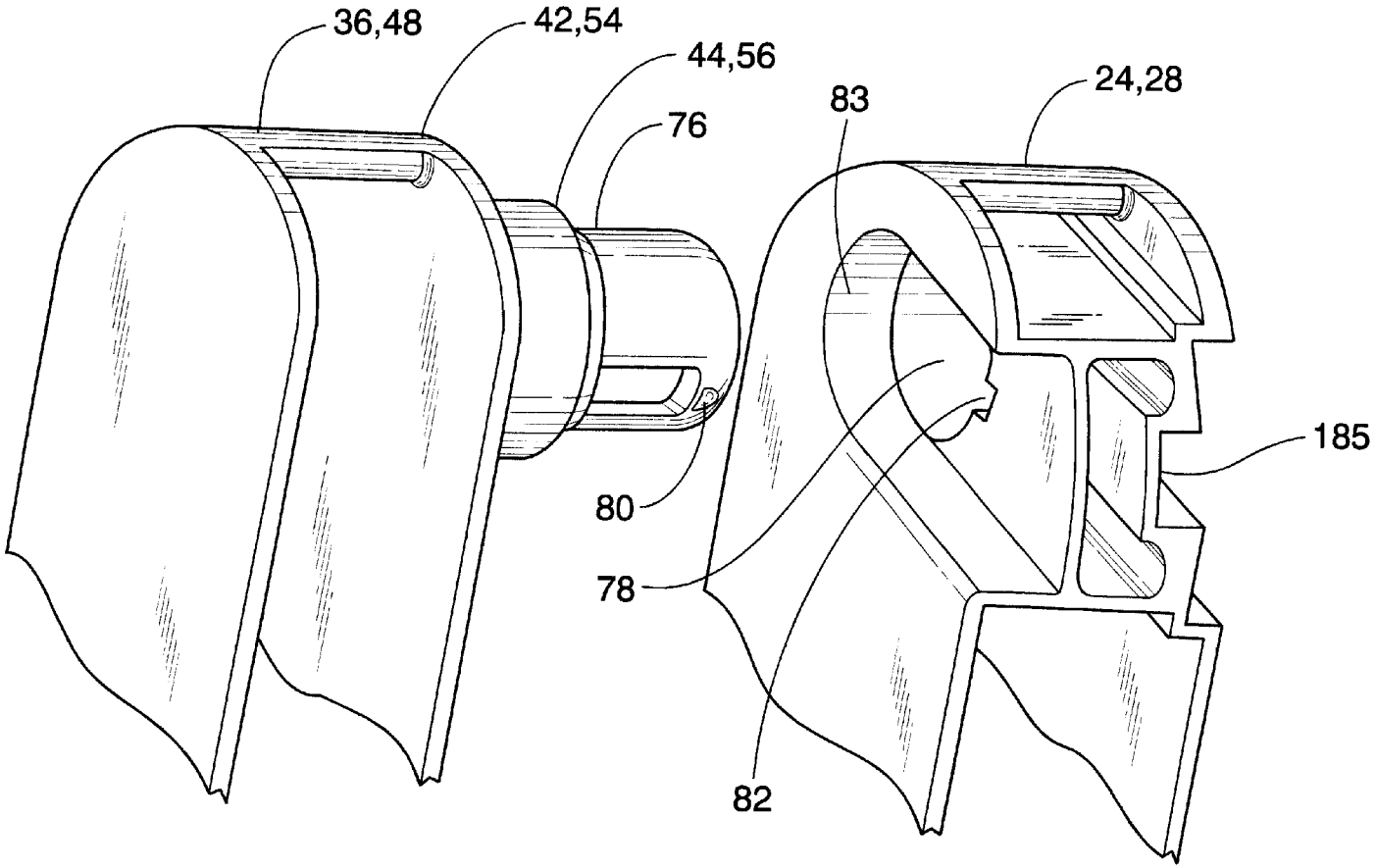
FIG. 12*a* is an exploded view of another embodiment of a pivotable connection between the arm members of the table top portions and the legs of the base member of the folding table of the present invention.
Figure 12B:
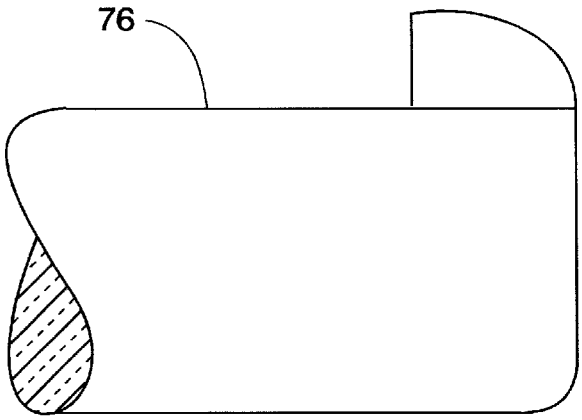
FIG. 12*b* is a portion of the side plan view of the lug of the arm members shown in FIG. 12*a;*
Figure 12C:
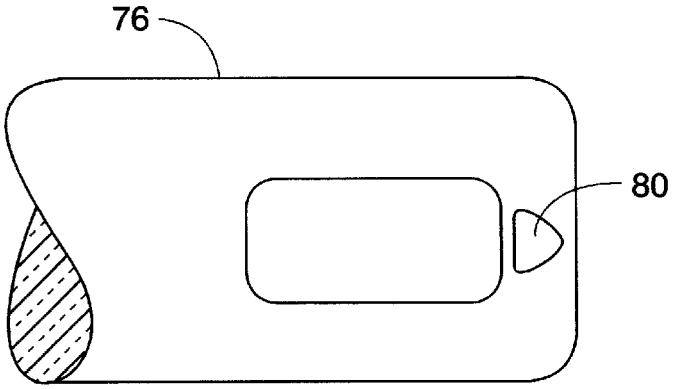
FIG. 12*c* is a portion of the top plan view of the lug of the arm members shown in FIG. 12*a;*

FIGS. 12*a*, 12*b* and 12*c* illustrate another embodiment of the pivotable connection between the arm members 36 and 48 and the legs 24 and 28. FIG. 12*a* is an exploded view of this pivotable connection between the arm members 36 and 48 and the legs 24 and 28; FIG. 12*b* is a portion of the side plan of the lug 76 of the arm members 36 and 48; and FIG. 12*c* is a portion of the top plan view of the lug 76 of the arm members 36 and 48. The pivotable connectors 44 and 56 each comprise a lug 76 connected to the arm members second ends 42 and 54, and an aperture 78 defined by the legs 24 and 28 at the first ends 58 and 62 thereof. In this embodiment, the lug 76 has a single protuberance 80 at the periphery thereof. The protuberance 80 is tapered along its length and height such that it may be easily inserted within slot 82 (FIGS. 12*b* and 12*c*). The aperture 78 has a single slot 82. The aperture 78 is sized and proportioned such that the lug 78 can be received within the aperture 78 when the protuberance 80 is aligned with the slot 82, but at no other time. Accordingly, when the protuberance 80 is aligned with the slot 82, the lug 76 is able to enter the aperture 78. The protuberance 80 must remain in alignment with the slot 82 until the protuberance 80 passes through the slot 82, at which time the arms 36 and 48 can rotate relative to the legs 24 and 28 and be locked into the fully assembled position (FIGS. 1 through 4). It should be noted that any number of protuberances 80 and slots 82 can be used in the present invention.

Figure 12D:
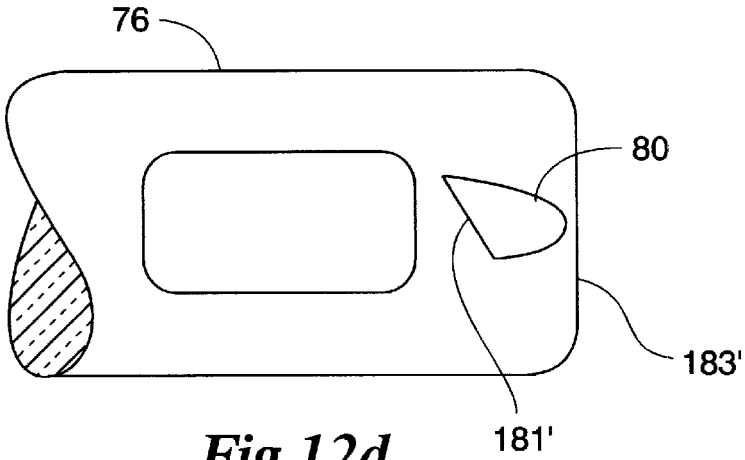
FIG. 12*d* is a portion of the top plan view of another embodiment of the lug of the arm members of the present invention.

FIG. 12*d* is a portion of the top plan view of another embodiment of the lug 76 of the arm members 36 and 48 of the present invention. In this embodiment the protuberance 80 has a substantially linear portion 181' that is angled relative to the front surface 183' of the lug 76 and the surface 185 of the legs 24 and 28 (FIG. 12*a*). When this embodiment is assembled, the lug 76 is received by the aperture 78, shown in FIG. 12*a*, such that the protuberance 80 is received within the slot 82 until the protuberance 80 passes completely through the aperture 78. The arm members 36 and 48 are then rotated relative to the legs 24 and 28 such that the linear portion 181' of the protuberance 80 engages the surface 185 (FIG. 12*a*) and rides up along the linear portion 181' resulting in the tightening of the connection between the legs 24 and 28 and the arm members 36 and 48.

Figure 13A:
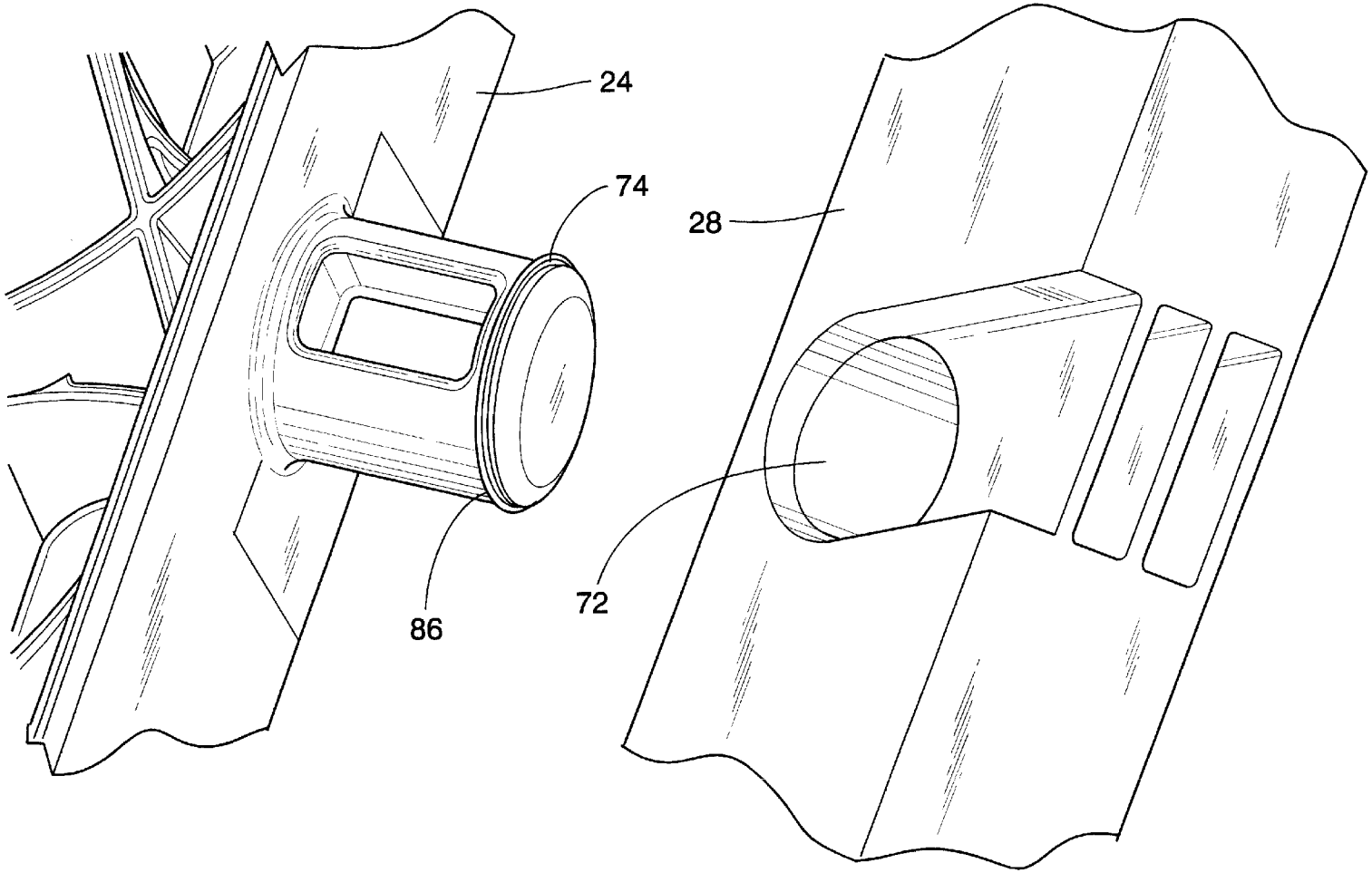
FIG. 13*a* is an enlarged view of a boss of the pivotable connection between the pair of inner legs and the pair of outer legs of the folding table of the present invention shown in FIG. 1.
Figure 13B:
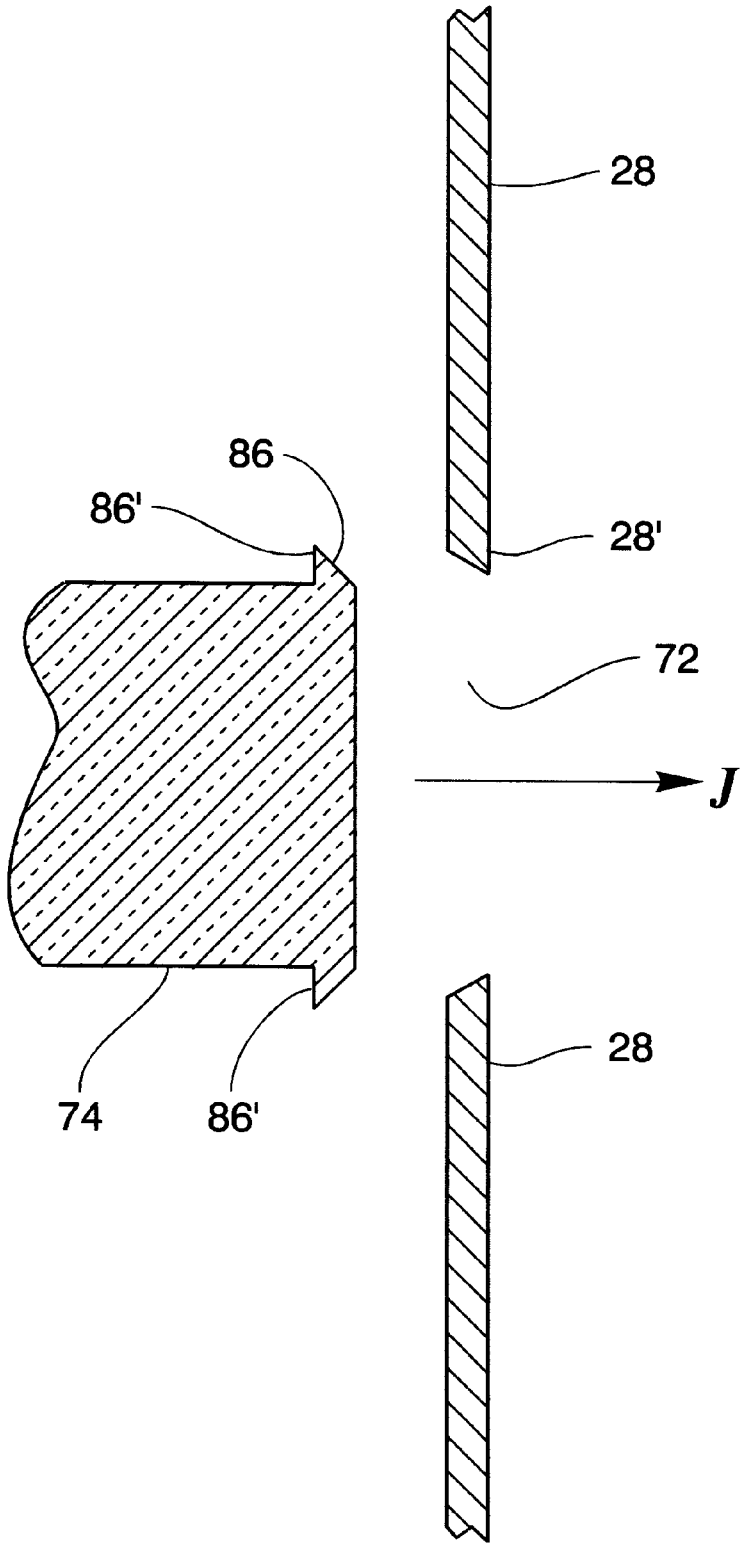
FIG. 13*b* is a sectional view of another embodiment of the pivotable connection between the pair of inner legs and the pair of outer legs of the folding table of the present invention.

FIG. 13*a* is an enlarged view of the boss 74 of the pivotable connection between the pair of inner legs 24 and the pair of outer legs 28 of the folding table 10 of the present invention. FIG. 13*b* is a sectional view of another embodiment of the pivotable connection between the pair of inner legs 24 and the pair of outer legs 28 of the folding table 10. Referring to FIG. 13*a*, the inner legs 24 each have a boss 74 extending substantially perpendicular to the longitudinal axes of the legs 24 at the intermediate portion 70 thereof. Each boss 74 has a bead 86 along the periphery thereof. Each of the outer legs 28 define a recess 72 that is sized and proportioned to receive the boss 74 such that the inner legs 24 and the outer legs 28 form an interference fit which enables the inner and outer legs 24 and 28 to pivot relative to one another and form a crisscross pattern, as shown in FIG. 1. It will be apparent to one of ordinary skill in the art that the boss 74 and bead 86 can take many shapes and sizes. For example, as seen in FIG. 13*b*, the bead 86 and the recess 72 may have complimentary tapered configurations. The boss 74 is received within the recess 72 as it moves in the J direction and the tapered bead 86 extends completely through the recess 72 defined by legs 28 such that the shoulder 86' of the bead 86 engages the exterior surface 28' of the outer legs 28 which prevents the boss 74 from moving in the direction opposite to the J direction thus, being disconnected from the outer legs 28 without applying substantial force. Thus, when the folding table 10 is opened and moves from a fully collapsed position (FIG. 20) to a fully assembled position (FIG. 1), the boss 74 and the outer legs 28 rotate relative to one another. Please note that the first table top portion 16, the second table top portion 18, the inner pair of legs 24 with the first brace member 26, and the outer pair of legs 28 with the second brace member 30 can each be molded as unitary pieces by injection molding. However, it should be understood that each of the above noted unitary pieces can also be formed of several pieces. Furthermore, it will also be apparent to one of ordinary skill in the art that the folding table 10 of the present invention may be manufactured by other methods and materials.

Figure 14:
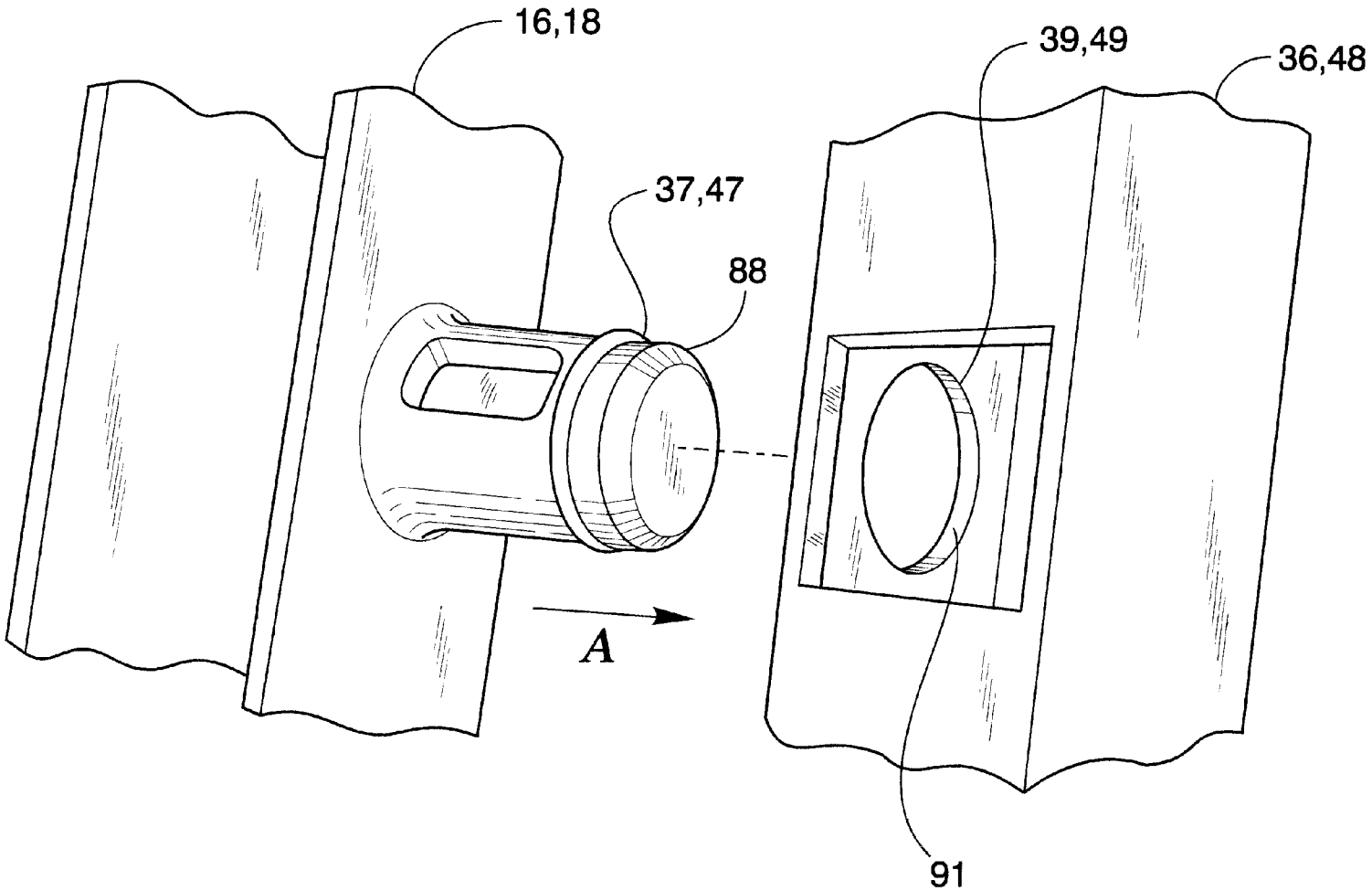
FIG. 14 is an exploded view of a projection and receptacle connector of the folding table of the present invention shown in FIG. 1.

FIG. 14 is an exploded perspective view of the projections 37 and 47 and receptacles 39 and 49 shown in FIGS. 5 and 6, of the first and second table top portions 16 and 18 of the folding table 10 of the present invention. The projections 37 and 47 may be cylindrical projections with a tapered end section 88, wherein the projections 37 and 47 extend substantially perpendicular from the first and second table top portions 16 and 18 and are fixedly connected thereto. The receptacles 39 and 49 are defined by the arm members 36 and 48. The projections 37 and 47 are sized and proportioned such that they may easily be received by the receptacles 39 and 49. The receptacles 39 and 49 are spaced from the projections 37 and 47 such that when the folding table 10 moves from the fully collapsed position (FIGS. 19 and 20) to the fully assembled position (FIG. 1), the projections 37 and 47 engage and are received within the receptacles 39 and 49. Thus, the projections 37 and 47 are moved toward the receptacles 39 and 49 in the direction A (FIG. 14) such that the projections 37 and 47 extend into the receptacles 39 and 49 preventing the first and second table top portions 16 and 18 from moving relative to one another. The projections 37 and 47 and the receptacles 39 and 49 may be sized and proportioned to form an interference fit. The projections 37 and 47 and the receptacles 39 and 49 are described in greater detail in connection with FIGS. 21 and 22.

Figure 15:
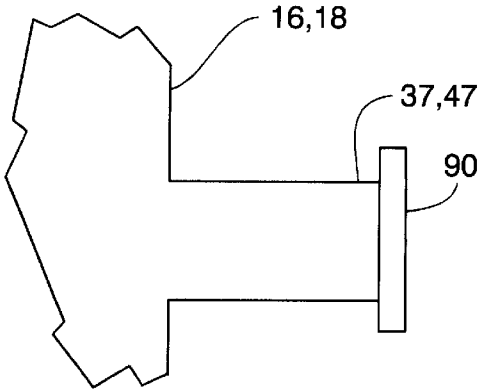
FIG. 15 is an elevational view of another embodiment of the projection of the folding table of the present invention.

FIG. 15 is an elevational view of another embodiment of the projections 37 and 47 of the folding table of the present invention. In this embodiment, the projections 37 and 47 are substantially cylindrically shaped and extend from the first and second table top portions 16 and 18. The projections 37 and 47 have an angled rib 90 on the end thereof that has a larger diameter than the receptacles 39 and 49. The receptacles 39 and 49 take the same form of that shown in FIG. 14 and are sized and proportioned to receive the projections 37 and 47 shown in FIG. 15. Thus, the projections 37 and 47 are urged into the receptacles 39 and 49 in the direction A (FIG. 14) such that the rib 90 extends into the receptacles 39 and 49 and such that the angled rib 90 will engage the edge 91 of the receptacles 39 and 49. If the projections 37 and 47 are pulled in the direction opposite to direction A, the edge 91 will engage the rib 90 and prevent the projections 37 and 47 from becoming disengaged from the receptacles 39 and 49 unless substantial force is used.

Figure 16:
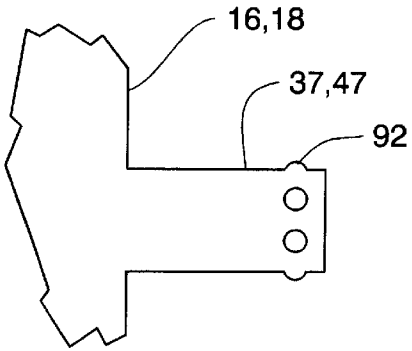
FIG. 16 is an elevational view of another embodiment of the projection of the folding table of the present invention.

FIG. 16 is an elevational view of another embodiment of the projections 37 and 47 of the folding table 10 of the present invention. In this embodiment, the projections 37 and 47 are substantially cylindrically shaped and extend from the first and second table top portions 16 and 18. The projections 37 and 47 have a plurality of bumps 92 around the periphery thereof such that the bumps 92 will act to lock the projections 37 and 47 within the receptacles 39 and 49. The receptacles 39 and 49 take the same form as that shown in FIG. 14. The diameter of receptacles 39 and 49 is smaller than the outer dimensions of the bumps 92 of the projections 37 and 47 such that the projections 37 and 47 form an interference fit with the receptacles 39 and 49. Thus, the projections 37 and 47 are urged into the receptacles 39 and 49 in the direction A (FIG. 14) such that the bumps 92 extend into the receptacles 39 and 49. If the projections 37 and 47 is pulled in the direction opposite to direction A, the edge 91 will engage the bumps 92 and thus, the projections 37 and 47 will be prevented from becoming disengaged from the receptacles 39 and 49 unless substantial force is used.

Figure 17:
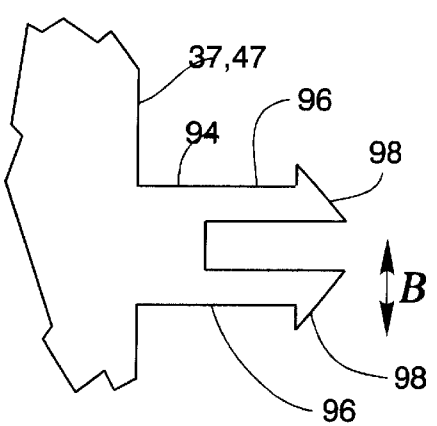
FIG. 17 is an elevational view of yet another embodiment of the projection of the folding table of the present invention.

FIG. 17 is an elevational view of yet another embodiment of the projections 37 and 47 of the folding table 10 of the present invention. In this embodiment, the projections 37 and 47 have a cylindrical section 94 and two spring fingers 96 that are able to flex in the directions shown by arrow B. The spring fingers 96 have tangs 98 on the ends thereof that will act to lock the projections 37 and 47 within the receptacles 39 and 49. The receptacles 39 and 49 may take the same form as that shown in FIG. 14 and are sized and proportioned to receive the projections 37 and 47 shown in FIG. 17. The projections 37 and 47 are urged into the receptacles 39 and 49 in the direction A (FIG. 14) such that the locking fingers 96 flex toward each other and extend into the receptacles 39 and 49. The tangs 98 are tapered such that when the tangs 98 engage the receptacles the spring fingers 96 will move towards one another. If the projections 37 and 47 is pulled in the direction opposite to A, the edge 91 will engage the tangs 98 and thus, the projections 37 and 47 will be prevented from becoming disengaged from the receptacles 39 and 49 unless substantial force is used.

Figure 18A:
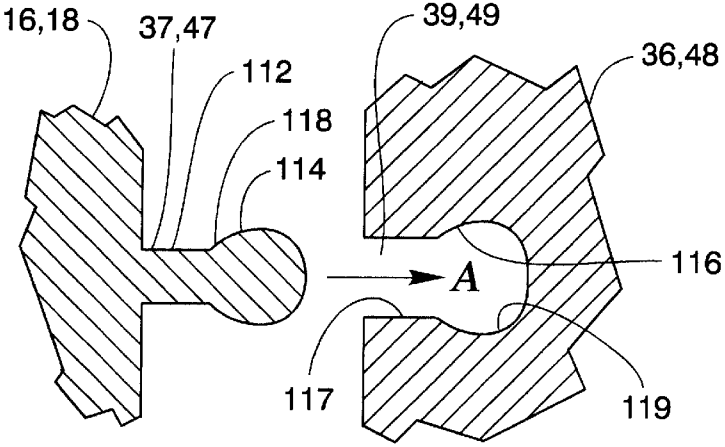
FIG. 18*a* is a sectional view of another embodiment of a projection and receptacle connector of the folding table of the present invention.

FIG. 18*a* is a cross-sectional view of another embodiment of the projections 37 and 47 and receptacles 39 and 49 of the folding table 10 of the present invention. In this embodiment, the projections 37 and 47 have a cylindrical section 112 and a spherical end section 114. The receptacles 39 and 49 are sized and proportioned to matingly receive the projections 37 and 47, also shown in FIG. 18*a*, in that the shape of the receptacle 39 and 49 substantially corresponds to the shape of the projections 37 and 47. The diameter of the spherical end section 114 is larger than the diameter of the inlet portion 117 of the receptacles 39 and 49 such that a snap fit connection is formed between the projections 37 and 47 and the receptacles 39 and 49. Thus, the projections 37 and 47 are urged into the receptacles 39 and 49 in the direction A such that the spherical section 114 enters the receptacles 39 and 49 into the bulbous recess 119. If the projections 37 and 47 is pulled in the direction opposite to A, the tapered edge 118 of the projections 37 and 47 will engage the corresponding edge 116 of the receptacles 39 and 49 and thus, the projections 37 and 47 will be prevented from becoming disengaged from the receptacles 39 and 49 unless substantial force is used.

FIG. 18*b* illustrates yet another embodiment of the projections 37 and 47 of the present invention, wherein each of the projections 37 and 47 has two semi-spherical sections 115 and a hollow portion 41. The receptacles 39 and 49 each have an inlet portion 117 and a bulbous portion 119, wherein the diameter of the inlet portion 117 is smaller than the diameter of the two semi-spherical sections 115 such that the two semispherical sections 115 are urged toward each other into the hollow portion 41 when the projections 37 and 47 are inserted into the receptacles 39 and 49. Once the semispherical sections 115 are inserted into the receptacles 39 and 49, they are prevented from being disengaged therefrom because the edge 118 of the sections 115 engages the edge 116 of the receptacles 39 and 49. Although not illustrated, the projections 37 and 47 and the receptacles 39 and 49 can take many other sizes and shapes as is apparent to one of ordinary skill in the art.

Figure 21:
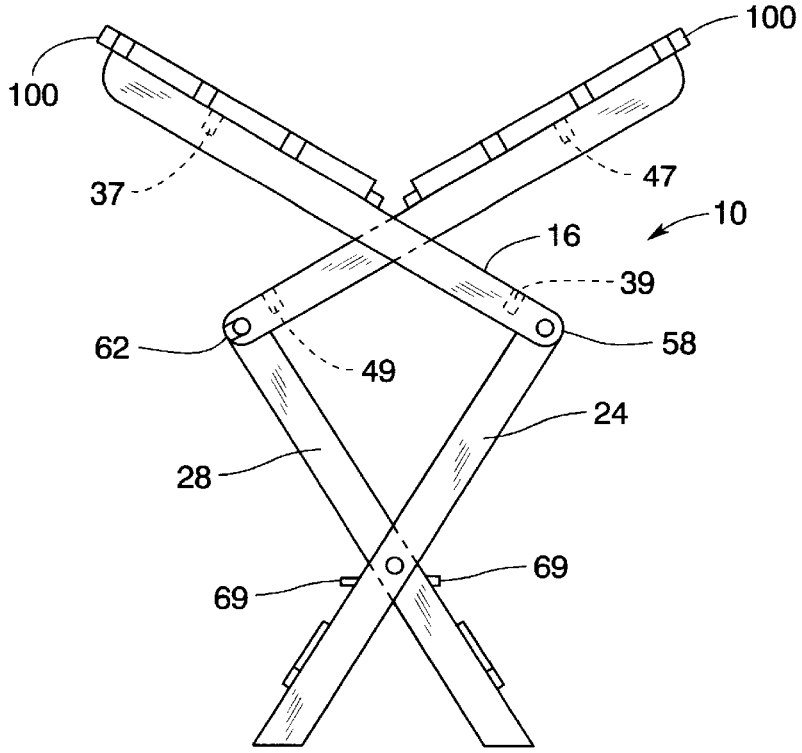
FIG. 21 is side view of the folding table of the present invention show in FIG. 1 in the partially collapsed position.
Figure 22:
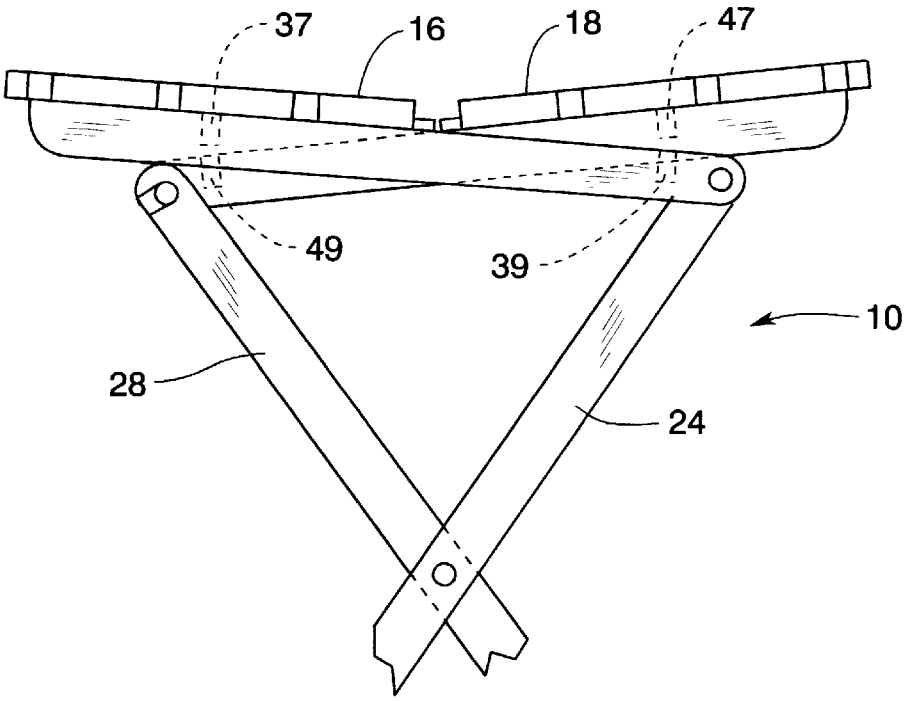
FIG. 22 is a partial side view of the folding table of the present invention shown in FIG. 1 in the partially collapsed position, wherein the projection and receptacle connectors are shown in hidden lines.

Referring to FIGS. 19 through 22, FIG. 19 is a partial side view of the folding table 10 of the present invention in the fully collapsed position; FIG. 20 is front view of the folding table 10 in the fully collapsed position; FIG. 21 is side view of the folding table 10 in the partially collapsed position; and FIG. 22 is an enlarged portion of the side view of the folding table in the partially collapsed position, wherein the projections 37 and 47 and receptacles 39 and 49 are shown in hidden lines. In use, the folding table 10 may be positioned in a fully collapsed position as shown in FIGS. 19 and 20 such that it can be carried using the handle portion 32 or stored easily. In the fully collapsed position, the inner and outer pair of legs 24 and 28, and the first and second table top portions 16 and 18 achieve a substantially vertical position such that the first and second table top portions 16 and 18 collapse on either side of the inner and outer pair of legs 24 and 28, as shown in FIG. 19. When in the fully collapsed position, the projections 137 and 147 of the first and second table top portions 16 and 18 (FIGS. 5 and 6) engage the receptacles 139 of the inner and outer legs 24 and 28 (FIGS. 10 and 9) such that when the user is carrying the folding table 10 in the fully collapsed position, the first and second table top portions 16 and 18 will remain in a substantially vertical position. The projections 137 and 147 and the receptacles 139 may take the form of the projections 37 and 47 and the receptacles 39 and 49, respectively, discussed in detail above in connection with FIGS. 14–17, 18*a* and 18*b*. Additionally, when the folding table 10 is in the fully collapsed position (FIG. 19), the ledges 69 which extend from the legs 24 and 28 (FIGS. 9 and 10) extend between the slat members 22 of the first and second table top portions 16 and 18. If the folding table 10 is in the fully collapsed position and it is dropped or impacts another object, the momentum from the impact may force the first and second table top portions 16 and 18 to separate from the legs 24 and 28. In this situation, the ledges 69 may contact the first and second table top portions 16 and 18 and absorb some of the force on the connections of the folding table 10.

The folding table 10 can be transformed from the fully collapsed position (FIGS. 19 and 20) to the fully assembled position (FIGS. 1 through 4). First the user may move the first and second table top portions 16 and 18 from the vertical position (FIG. 19) to an angled position (FIG. 21) then to a horizontal position (FIG. 4) by grasping the first and second table top portions 16 and 18 at their distal ends 100 thereof and pivot the table top portions 16 and 18 about the first ends 62 and 58 of the inner and outer pair of legs 24 and 28. Before the first and second table top portions 16 and 18 may be moved to the horizontal position, the projections 37 and 47 should be received within the receptacles 49 and 39, respectively, as shown in FIG. 22. While the first and second table top portions 16 and 18 are moving from a vertical position to a horizontal position, the inner and outer pairs of legs 24 and 28 are moving from a vertical position (FIG. 19) to an angled and crisscrossed pattern (FIG. 4). In order to transform the folding table 10 from the fully assembled position to the fully collapsed position, the user may disengage the projections 37 and 47 from the receptacles 39 and 49 and then pivot the first and second table top portions 16 and 18 about the first ends 62 and 58 of the inner and outer legs 24 and 28 to the vertical position shown in FIG. 19.

Figure 23:
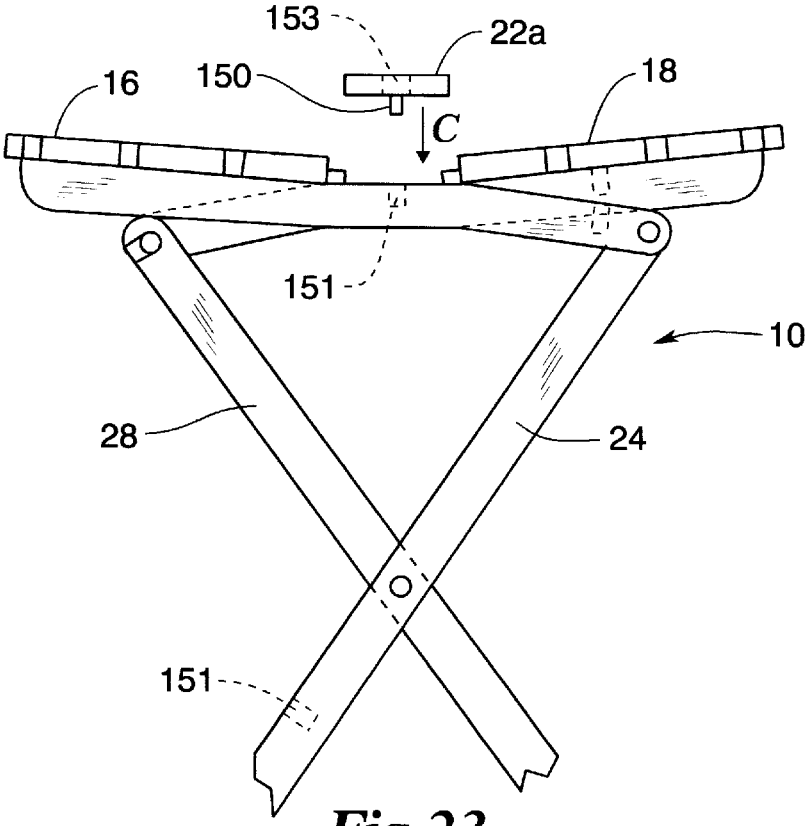
FIG. 23 is another embodiment of the folding table of the present invention having an additional slat member.

FIG. 23 is another embodiment of the folding table 10 of the present invention having an additional removable slat member 22*a*. Slat member 22*a* is an elongated member having at least one projection 150 and an opening 153 along the length thereof . The opening 153 is sized and proportioned to receive the stem of a patio umbrella (not shown). The slat member 22*a* may be made of the same material of the first and second table top portions 16 and 18 such as a plastic material. The addition of removable slat member 22*a* results in an increase in the overall surface area of the table top 12 of the folding table 10. Thus, in order to further increase the surface area of the table top 12, the removable slat member 22*a* may be made wider or more than one slat member 22*a* may be used. Please note that the projection 150 and the receptacle 151 may take the form of any of the projections 37 and 47 and the receptacles 39 and 49 discussed above in connection with FIGS. 14–17, 18*a* and 18*b*. The projection 150 may be received either within receptacle 151 defined by one of the arm members 36 and 48 or received within receptacle 139 defined by one of the legs 24 and 28 (FIGS. 9 and 10). When the folding table 10 is being moved from the fully collapsed position (FIG. 19) to the fully assembled position (FIG. 1), the removable slat member 22*a* may be inserted between the first table top portion 16 and the second table top portion 18 by aligning the removable slat member 22*a* with the slat members 22 of the first and second table top portions 16 and 18 and positioning the projection 150 of the removable slat member 22*a* within the receptacle 151 of one of the arm members 36 and 48. When the removable slat member 22*a* is not being used or the table 10 is in the fully collapsed position (FIG. 19), the removable slat member 22*a* may be attached to one of the legs 24 and 28 by inserting the projection 150 into the receptacles 139 (FIGS. 9 and 10).

Figure 24:
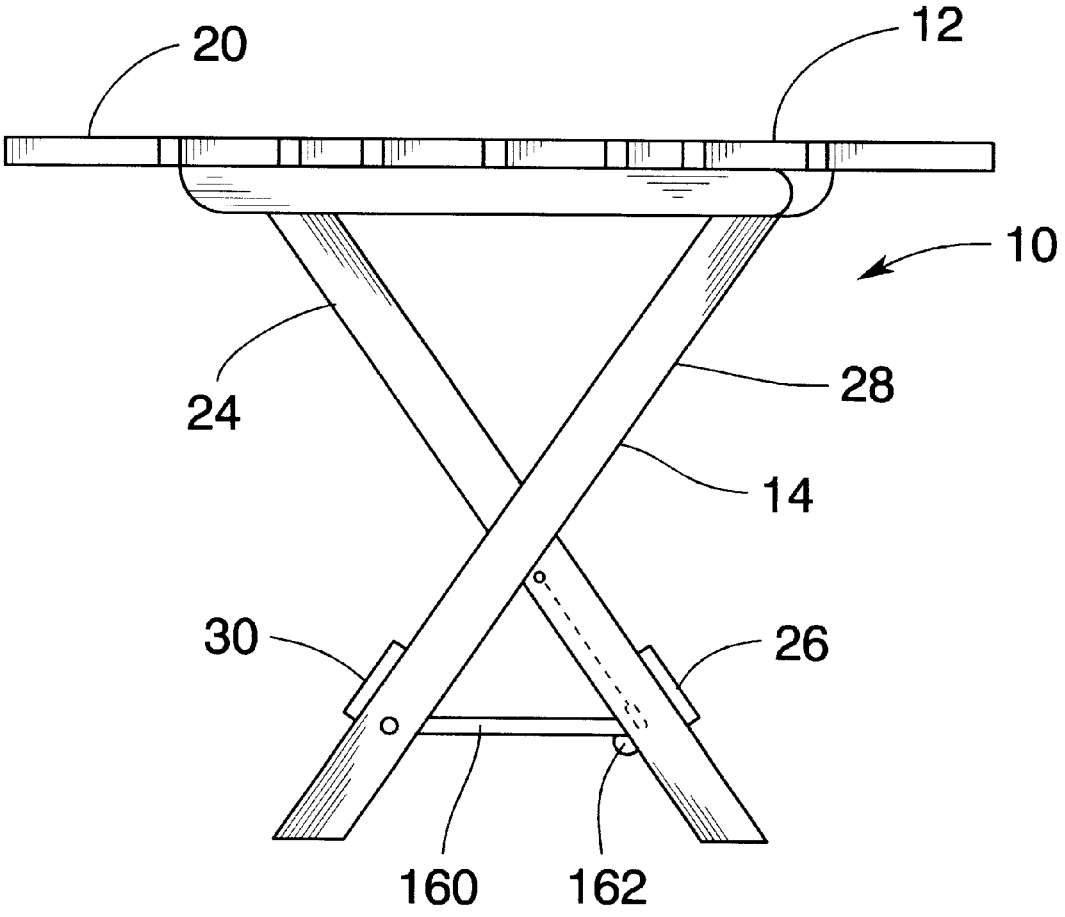
FIG. 24 is a side plan view of another embodiment of the folding table of the present invention having a retractable brace with a living hinge, wherein the retractable brace is in the extended position.
Figure 25A:
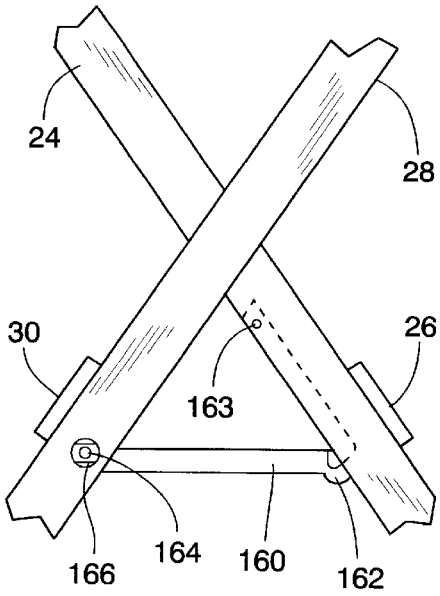
FIG. 25*a* is an enlarged view of the retractable brace shown in FIG. 24 in the extended position.
Figure 25B:
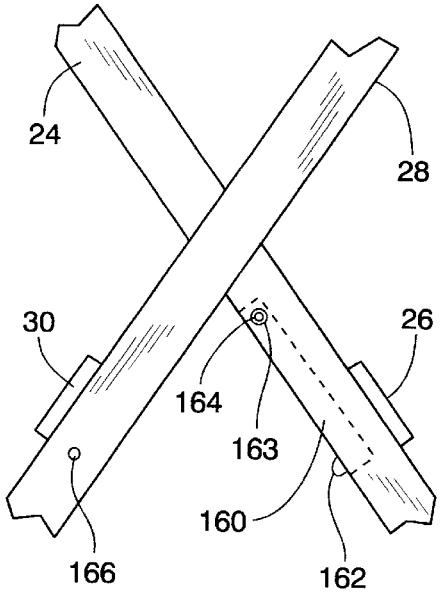
FIG. 25*b* is an enlarged view of the retractable brace shown in FIG. 24 in the collapsed position.

FIGS. 24, 25*a* and 25*b* illustrated another embodiment of the folding table 10 of the present invention having a retractable brace 160 with a living hinge 162, wherein the retractable brace 160 is illustrated in the extended position in FIGS. 24 and 25*a* and the retractable brace 160 is shown in hidden lines and illustrated in the collapsed position in FIG. 25*b*. As shown in FIGS. 24, 25*a* and 25*b*, the retractable brace 160 may be defined by a portion of each of the inner legs 24; however, the retractable brace 160 may also be defined by the outer legs 28. The retractable brace 160 is an elongated body having a living hinge 162 at one end of the elongated body and a peg 164 at the other end of the elongated body, wherein the retractable brace 160 and the inner leg 24 are a unitary body. The peg 164 may be a cylindrical member extending substantially perpendicular to the brace 160; however, other configurations may also be used. The retractable brace 160 is connected to the inner leg 24 by the living hinge 162 and thus, is able to pivot about the living hinge 162 from a collapsed position (FIG. 25*b*) to an extended position (FIGS. 24 and 25*a*). When the retractable brace 160 is in the extended position (FIGS. 24 and 25*a*), the retractable brace 160 is held in place by the peg 164 being received in recess 166 defined by the outer leg 28. When the retractable brace 160 is in the collapsed position, it is held in place by the peg 164 being received within the recess 163. When the retractable brace 160 is in the extended position (FIGS. 24 and 25*a*) it strengthens the structural configuration of the folding table 10.

Figure 25C:
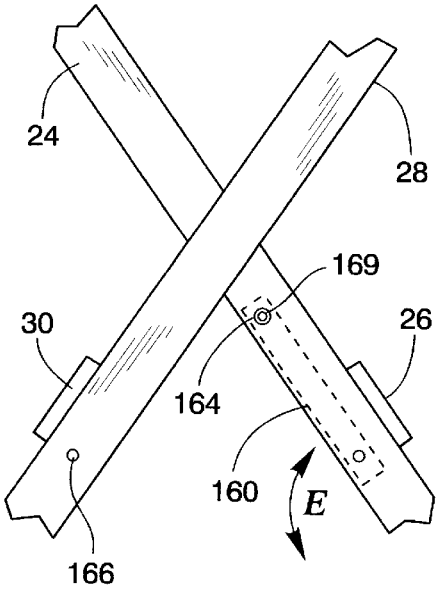
FIG 25*c* is an enlarged view of a portion of another embodiment of the folding table of the present invention having a retractable and detachable brace in the collapsed position.
Figure 25D:
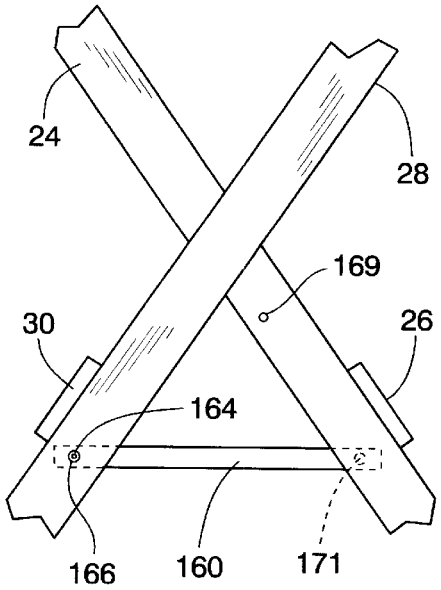
FIG. 25*d* is an enlarged view of a portion of the folding table of the present invention shown in FIG. 25*c,* wherein the brace is in the extended position.

FIGS. 25*c* and 25*d* are enlarged views of a portion of another embodiment of the folding table 10 of the present invention having a retractable and detachable brace 160 shown in the collapsed and extended position, respectively. The retractable brace 160 comprises an elongated member having a peg 164 fixedly connected at one end thereof and a snap-fit connector 171 connected to the other end thereof, wherein the snap-fit connector 171 provides a pivotable connection between the brace 160 and the leg 24 such that the retractable brace 160 can pivot about the snap-fit connector 171. The snap-fit connector 171 may take the form of the projections 37 and 47 and receptacles 39 and 49 described previously in connection with FIGS. 14–17, 18*a* and 18*b*. The snap-fit connector 171 further provides for the retractable brace 160 to be detached from the leg when a sufficient amount of force is used to disengage the snap-fit connector 171. In the collapsed position (FIG. 25*c*), the retractable brace 160, shown in hidden lines, is aligned with the longitudinal axis of the leg 24 and the peg 164 is received within opening 169 such that the retractable brace 160 is held in the collapsed position (FIG. 25*c*). When the retractable brace 160 is in the extended position (FIG. 25*b*), the retractable brace 160 is held in place by the peg 164 being received within opening 166 of the outer leg 28.

Figure 26:
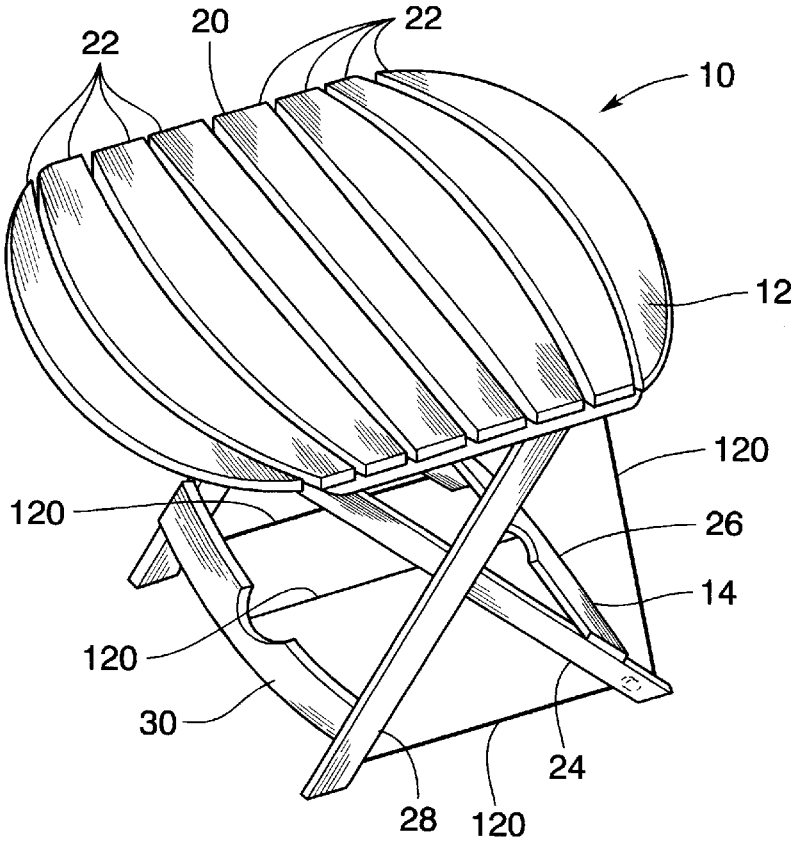
FIG. 26 is a perspective view of another embodiment of the folding table of the present invention having another type of retractable brace.
Figure 27A:
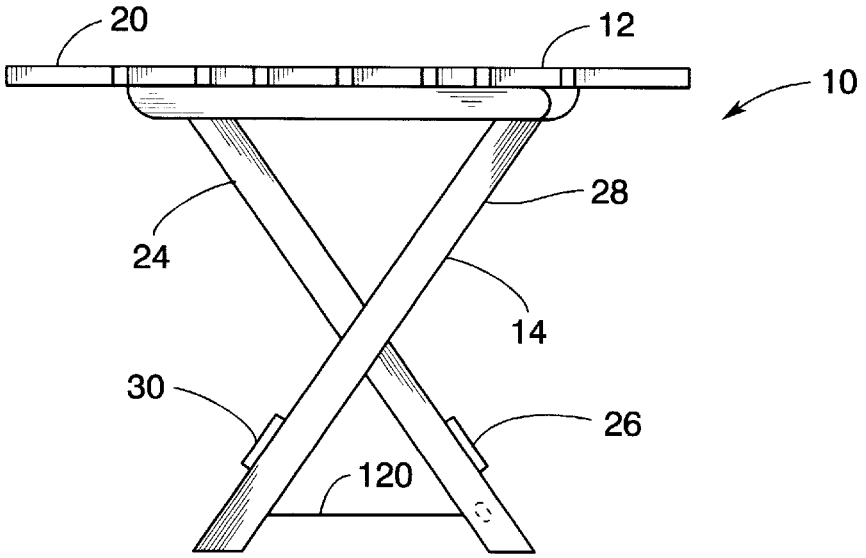
FIG. 27*a* is a side plan view of the folding table shown in FIG. 26.
Figure 27B:
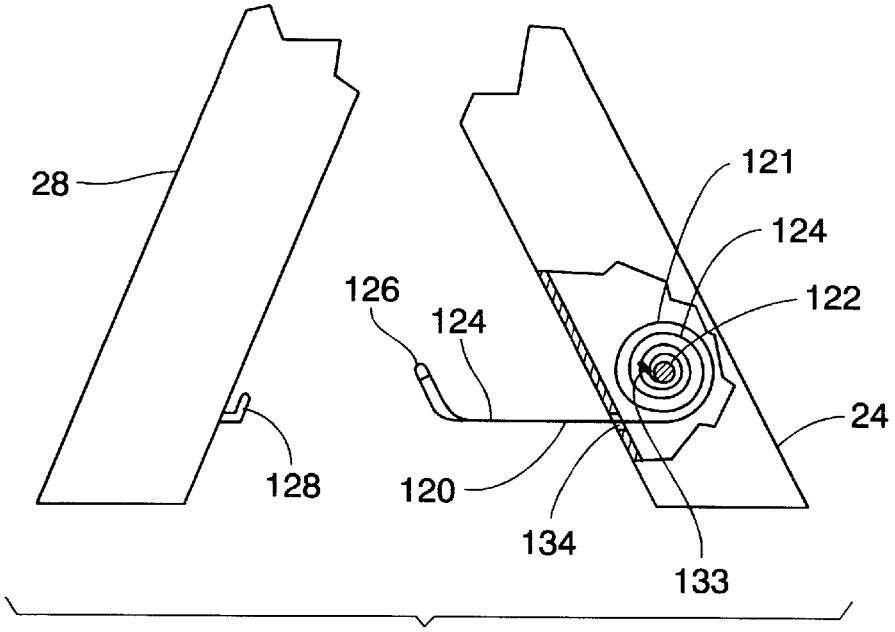
FIG. 27*b* is an enlarged view of the retractable brace of the folding table of the present invention shown in FIG. 26, wherein the retractable brace is in the partially contracted position.

FIGS. 26, 27*a* and 27*b* illustrate another embodiment of the folding table 10 of the present invention having other retractable braces 120. In this embodiment, each of the retractable braces 120 (FIG. 27*b*) comprises a housing 121, a torsion spring 122, a wire member or tape 124 with a loop member 126 on the end thereof and a hook 128. The housing 121 is fixedly mounted inside the inner leg 24. The housing 121 can be a variety of shapes; however, in this embodiment the housing 121 is circular shaped. The torsion spring 122 and the wire member 124 are mounted in the housing 121 such that the wire member 124 may be wound and unwound around the torsion spring 122. The torsion spring 122 may be a commercially available product that is sized and proportioned for the specific application. The wire member 124 may be a metal such as steel; however, other material apparent to one of ordinary skill in the art may also be employed. The wire member 124 is fixedly attached to the torsion spring 122 at one end thereof. The loop member 126 is fixedly attached to the other end of the wire member 124. The wire member 124 has a stop 133 fixedly attached along the length of the wire member 124 which prevents the wire member 124 from extending from the inner leg 24 beyond a desired length. The stop 133 may be any shaped member that has a width that is greater that the opening 134 in the inner leg 24 through which the wire member 124 extends. The hook 128 is fixedly attached to the outer leg 28. The hook 128 and loop member 126 may be selected from commercially available products. An alternative embodiment of the present invention may eliminate the stop 133 by making the wire member 124 have a length equal to the desired length of separation between the inner and outer legs 24 and 28. Furthermore, although not illustrated, other releasable or permanent fasteners can be used in place of the loop member 126 and hook 128.

A retractable brace 120 may be mounted in both inner legs 24 such that the retractable brace 120 extends between each of the inner and outer leg 24 and 28. A retractable brace 120 may also be mounted on either of the first and second brace members 26 and 30 such that when the retractable brace 120 is in the extended position (FIG. 26), the retractable brace 120 will extend between the first and second brace members 26 and 30. The retractable brace member 120 may also be mounted on either of the inner and outer legs 24 and 28 such that it extends between the inner and outer legs 24 and 28 and the table top 12 (FIG. 26).

When transforming the retractable brace 120 from the collapsed position to the fully extended position, the user pulls the wire member 124 from the leg 24 such that the wire member 124 extends in the direction of the hook 128 and connects the loop 126 to the hook 128. The stop 133 prevents the wire member 124 from extending through the opening 134 beyond the desired length. Specifically, the desired length is the desired length between the inner and outer legs 24 and 28 when the table 10 is in the fully assembled position. The loop 126 engages the hook 128 and the wire member 124 acts to strengthen the folding table 10. Alternatively, the user may initially connect the hook 128 and the loop member 126 and then unfold the legs 24 and 28 from the collapsed position to the fully assembled position. As noted above, retractable braces 120 may be mounted in a variety of positions on the folding table 10 depending on what portion of the folding table 10 needs to be strengthened.

Figure 28:
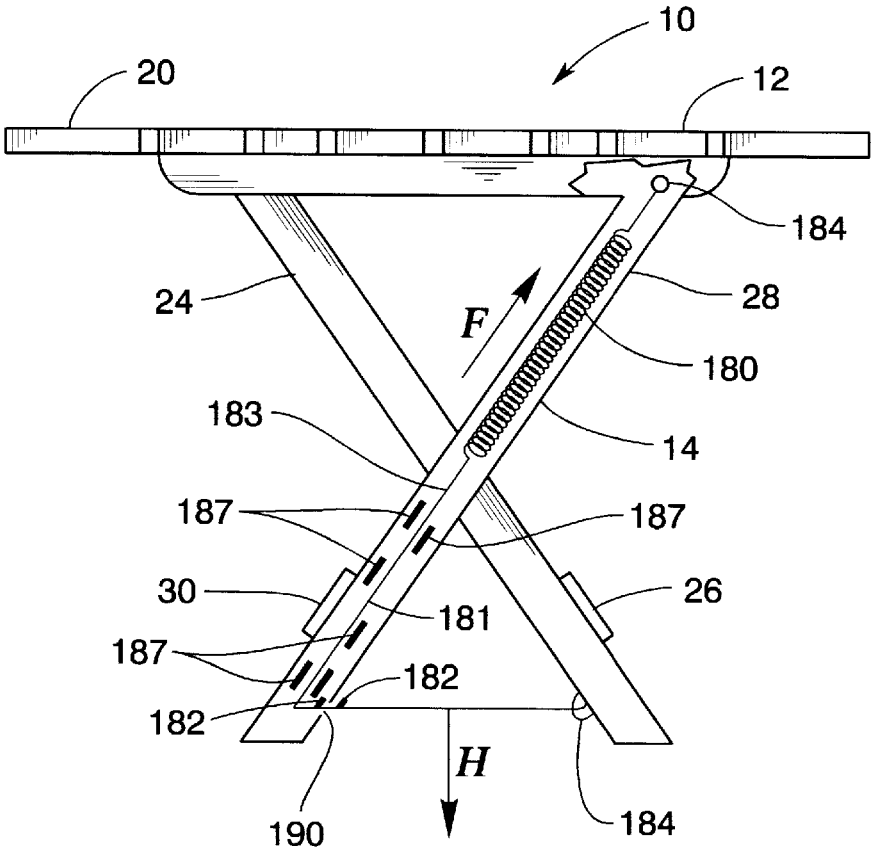
FIG. 28 is a partial cut-away side view of another embodiment of the folding table of the present invention in the fully assembled position.
Figure 29:
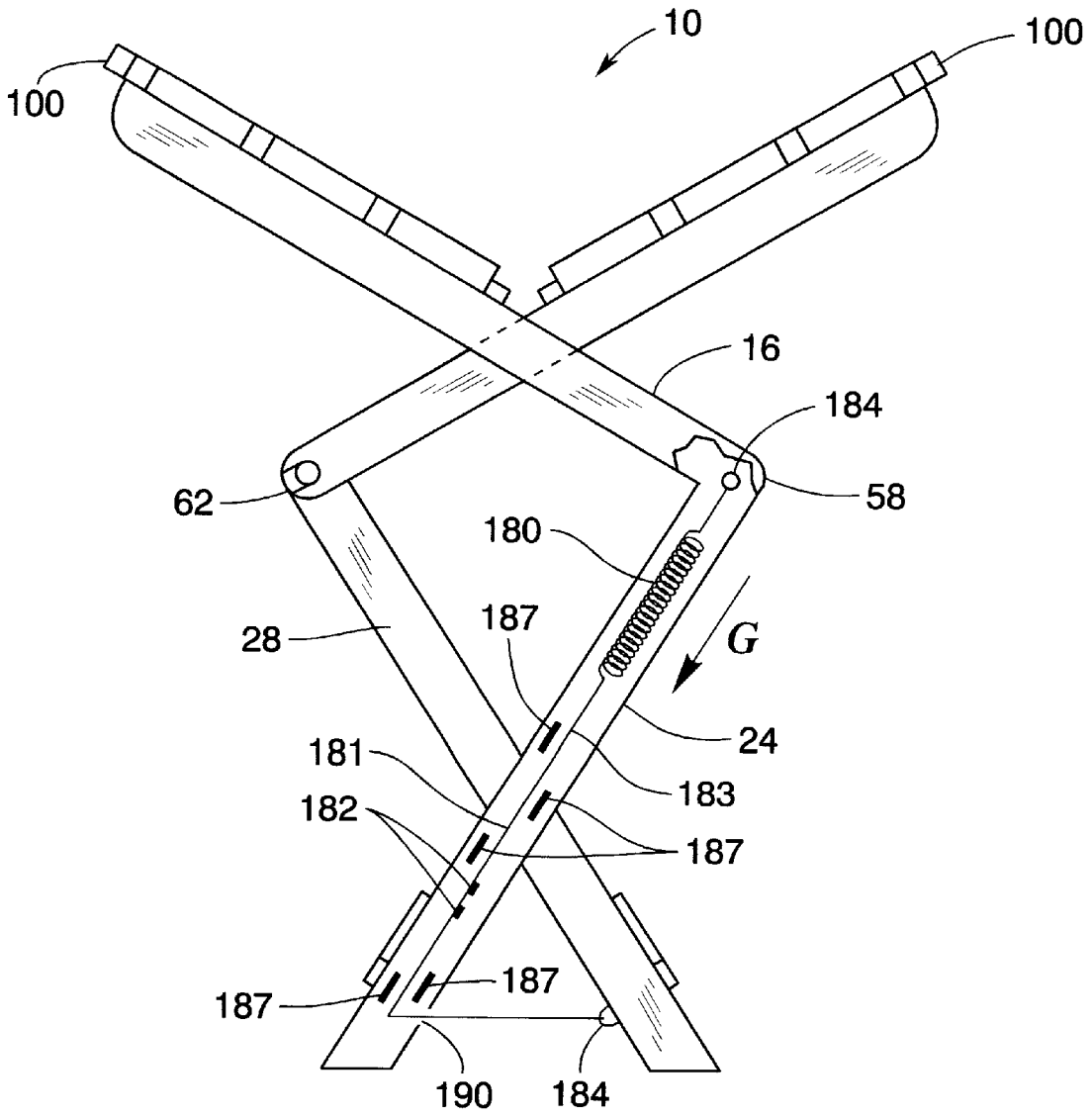
FIG. 29 is a partially cut-away side view of the folding table shown in FIG. 28, wherein the table is in the partially collapsed position.

FIGS. 28 and 29 illustrate yet another embodiment of the folding table of the present invention, wherein FIG. 28 illustrates the folding table in the fully assembled position and FIG. 29 illustrates the folding table in the partially collapsed position. This embodiment of the folding table 10 of the present invention comprises a biasing member 180, a flexible elongated portion 183, protuberances 182, guides 187 and connectors 184. The biasing member 180 may be made from metal wire or other suitable. The strength of the biasing member 180 will be dependent on the application. The biasing member 180 may take the form of a tape such as the tape 124 described in connection with FIGS. 27*a* and 27*b* or a spring, as shown in FIGS. 28 and 29. The flexible elongated portion 183 may be made of the same material as the biasing member 180; therefore if the spring member 180 is made of metal wire, the flexible portion 183 may also be made of flexible metal wire. Along the length of the flexible elongated portion 183 is a plurality of protuberances 182. The protuberances 182 are fixedly connected to the flexible elongated portion 183 and are spaced along the flexible elongated portion 183 such that when the folding table 10 is in the fully assembled position (FIG. 28), one of the protuberances 182 engage the exterior portion of the leg 28 and prevent the biasing member 180 from moving in the direction F. The outer leg 28 may have guides 187 fixedly connected to the interior of the leg 28 such that the guides 187 form a pathway for the flexible portion 181. The guides 187 may be substantially flat members; however, many other configurations may be employed. The guides 187 are sized and proportioned such that the protuberances 182 can freely move therebetween. The guides 187 may be formed from plastic material or from any other suitable material that will be apparent to one of ordinary skill in the art. The flexible portion 181 is connected to the leg 28 by connectors 184. The connectors 184 may be adhesive or connectors similar to the loop and hook connectors 126 and 128 as shown and described in connection with FIG. 27*b*. Although not illustrated, the biasing member 180, the elongated portion 183 and the guides 187 may alternatively be mounted within inner leg 24.

When the user moves the table 10 from a collapsed position, to a partially collapsed position (FIG. 29) to a fully assembled position (FIG. 28), the biasing member 180 and the protuberances 182 are pulled in the G direction (FIG. 29) while the legs 24 and 28 are moved away from each other. Once the protuberances 182 are proximate the opening 190 of leg 28, the user forces the elongated flexible portion 183 in the direction H by using his or her foot such that the protuberances 182 may pass through opening 190 and thus engage the exterior of the leg 28 as shown in FIG. 28. When moving the folding table from the fully assembled position (FIG. 28) to the partially collapsed position (FIG. 29) and then finally to the fully collapsed position, the user must again disengage the protuberances 182 from the exterior of the leg 28 so that the flexible portion 183 will be free to move in the direction F (FIG. 28). The biasing member 180 will urge the elongated flexible portion 183 in the F direction.

Those of ordinary skill in the art will recognize, however, that many modifications and variations of the present invention may be implemented without departing from the spirit and scope of the present invention. The foregoing description and the following claims are intended to cover such modifications and variations.

What is claimed is:

1. A folding table, comprising:

a base member;

a first table top portion;

at least two first arm members each having a first end and a second end, each of said at least two first arm members connected to and extending from said first table top portion at said first end and pivotably connected to said base member at said second end;

a second table top portion;

at least two second arm members each having a first end and a second end, each of said at least two second arm members connected to and extending from said second table top portion at said first end and pivotably connected to said base member at said second end;

at least one projection fixedly connected to each of said first and second table top portions; and at least one receptacle defined by each arm member of said at least two first and second arm members such that when the table is in its assembled position said at least one projection of each of said first and second table top portions is received into said at least one receptacle of said at least two first and second members of the other of said first and second table top portions.

2. The table according to claim 1, wherein each of said plurality of projections are tapered.

3. The table according to claim 1, wherein each of said plurality of projections have a spherical portion and each of said plurality of receptacles also have a spherical portion that corresponds with said spherical shape of said plurality of projections.

4. The table according to claim 1, wherein each of said plurality of projections have a spring-biased member.

5. The table according to claim 1, wherein each of said plurality of projections have two spring-biased fingers.

6. The table according to claim 1, wherein each of said plurality of projections have a raised surface that extends radially with respect to said plurality of projections.

7. The table according to claim 6, wherein each of said plurality of projections have a plurality of bumps along the outside surface of said plurality of projections.

8. The table according to claim 6, wherein each of said plurality of projections have a ring surrounding said plurality of projections.

9. The table according to claim 1, wherein said table is made of plastic material.

10. The table according to claim 1, wherein each of said plurality of projections have two semi-spherical portions and a hollow portion between said two semi-spherical portions, and wherein each of said plurality of receptacles have a spherical portion.

11. The table of claim 1, further comprising:

a rod member connected to and extending between said at least two first arm members, said rod member having at least two fins extending radially therefrom and along a portion of the length of said rod member, at least one of said at least two fins engaging the underside of at least one of said first and second table top portions.

12. The table according to claim 11, wherein said rod member has a handle portion.

13. The table of claim 11, wherein said rod member has a waffle configuration engaging said fins.

14. The table according to claim 11, wherein said table is made from plastic material.

15. The table of claim 1, comprising:

a first pair of legs connected by a first brace member, each of said pair of first legs having a boss extending substantially perpendicular therefrom, said boss having a bead peripherally connected to said boss, said first pair of legs being pivotably connected to said first table top portion; and a second pair of legs connected by a second brace member, each of said pair of second legs defining a recess, each of said bosses being pivotably received within said recesses, said second pair of legs being pivotably connected to said second table top portion.

16. The table according to claim 15, wherein said bead and said recess are tapered.

17. The table according to claim 15, wherein said table is made of plastic material.

18. The table of claim 1, wherein each of said second ends of said at least two first and second arm members has a lug with at least one peripheral protuberance, and wherein the base member comprises:

a first pair of legs connected by a first brace member, each of said pair of first legs having a first end and a second end, each of said first pair of legs defining an aperture having a peripheral slot wherein said lugs of said first table top portion engage said apertures of said first pair of legs such that said at least one protuberance is received by said slot of said first pair of legs; and a second pair of legs connected by a second brace member, each of said pair of second legs having a first end and a second end, each of said second ends defining an aperture having a peripheral slot, wherein said lugs of said second table top portion engage said apertures of said second pair of legs such that each of said at least one protuberance of said second table top portion is received by said slots of said second pair of legs.

19. The table according to claim 18, wherein said at least one protuberance of said first table top portion and said at least one protuberance of said second table top portion each have a substantially linear portion that is at an angle relative to a front surface of each of said lugs of said first and second table top portions.

20. The table according to claim 18, wherein said lugs have a plurality of protuberances along said periphery of said lugs.

21. The table according to claim 18, wherein said apertures of said first pair of legs and said apertures of said second pair of legs have a plurality of slots along the periphery thereof.

22. The table according to claim 21, wherein said plurality of slots in said apertures are spaced from one another and said at least one protuberance of said first table top portion is positioned between said plurality of slots and said at least one protuberance of said second table top portion is positioned between said plurality of slots.

23. The table according to claim 18, wherein said at least one protuberance of said first table top portion and said at least one protuberance of said second table top portion are tapered.

24. The table according to claim 1, further comprising:

a first pair of legs pivotably connected to one of said first table top portion and said second table top portion, each of said first pair of legs having a receptacle; and a second pair of legs pivotably connected to the other of said first table top portion and said second table top portion, each of said second pair of legs having a receptacle, and wherein each of said first and second table top portions have a second plurality of projections connected to said first and second table top portions, wherein said receptacles of said first and second pair of legs receive said second plurality of projections of said first and second table top portions when said table is in a fully collapsed position.

25. The table according to claim 24, further comprising a slat member positioned in between said first table top portion and said second table top portion.

26. The table according to claim 25, wherein said slat member has at least one projection, which is received within one of a receptacle defined by said first and second pair of legs and a receptacle defined by said table top portions.

27. The table according to claim 24, wherein said first and second pair of legs each have a buttress.

* * * * *